US008926065B2

(12) United States Patent
Winger

(10) Patent No.: US 8,926,065 B2
(45) Date of Patent: Jan. 6, 2015

(54) DROPLET ACTUATOR DEVICES AND METHODS

(75) Inventor: Theodore Winger, Morrisville, NC (US)

(73) Assignee: Advanced Liquid Logic, Inc., San Diego, CA (US)

( * ) Notice: Subject to any disclaimer, the term of this patent is extended or adjusted under 35 U.S.C. 154(b) by 388 days.

(21) Appl. No.: 13/238,872

(22) Filed: Sep. 21, 2011

(65) Prior Publication Data

US 2012/0044299 A1 Feb. 23, 2012

Related U.S. Application Data

(63) Continuation-in-part of application No. PCT/US2010/040705, filed on Jul. 1, 2010.

(60) Provisional application No. 61/234,114, filed on Aug. 14, 2009, provisional application No. 61/294,874, filed on Jan. 14, 2010, provisional application No. 61/384,870, filed on Sep. 21, 2010.

(51) Int. Cl.
*B41J 2/135* (2006.01)
*B41J 2/16* (2006.01)

(52) U.S. Cl.
CPC ..... *B41J 2/1606* (2013.01)
USPC ..... 347/45; 347/47; 347/54

(58) Field of Classification Search
USPC ..... 347/20, 54, 56, 45, 63, 50
See application file for complete search history.

(56) References Cited

U.S. PATENT DOCUMENTS

| | | | |
|---|---|---|---|
| 4,636,785 | A | 1/1987 | Le Pesant |
| 5,181,016 | A | 1/1993 | Lee et al. |
| 5,486,337 | A | 1/1996 | Ohkawa et al. |
| 6,130,098 | A | 10/2000 | Handique et al. |
| 6,294,063 | B1 | 9/2001 | Becker et al. |
| 6,565,727 | B1 | 5/2003 | Shenderov |
| 6,773,566 | B2 | 8/2004 | Shenderov |
| 6,790,011 | B1 | 9/2004 | Le Pesant et al. |
| 6,911,132 | B2 | 6/2005 | Pamula et al. |
| 6,924,792 | B1 | 8/2005 | Jessop |
| 6,977,033 | B2 | 12/2005 | Becker et al. |
| 6,989,234 | B2 | 1/2006 | Kolar et al. |
| 7,052,244 | B2 | 5/2006 | Fouillet et al. |
| 7,163,612 | B2 | 1/2007 | Sterling et al. |
| 7,211,223 | B2 | 5/2007 | Fouillet et al. |
| 7,255,780 | B2 | 8/2007 | Shenderov |
| 7,328,979 | B2 | 2/2008 | Decre et al. |

(Continued)

FOREIGN PATENT DOCUMENTS

| | | | |
|---|---|---|---|
| WO | 0069565 | A1 | 11/2000 |
| WO | 0073655 | A1 | 12/2000 |

(Continued)

OTHER PUBLICATIONS

Jean-Maxime Roux and Yves Fouillet, "3D droplet displacement in microfluidic systems by electrostatic actuation," Sensors and Actuators A, vol. 134, Issue 2, pp. 486-493, Mar. 15, 2007.

(Continued)

*Primary Examiner* — Juanita D Jackson
(74) *Attorney, Agent, or Firm* — William A. Barrett; Ward & Smith, P.A.

(57) ABSTRACT

A microfluidic device having a substrate with an electrically conductive element made using a conductive ink layer underlying a hydrophobic layer.

26 Claims, 3 Drawing Sheets

(56) References Cited

U.S. PATENT DOCUMENTS 7,329,545 B2 2/2008 Pamula et al.
7,439,014 B2 10/2008 Pamula et al.
7,458,661 B2 * 12/2008 Kim et al. ..... 347/47
7,531,072 B2 5/2009 Roux et al.
7,547,380 B2 6/2009 Velev
7,569,129 B2 8/2009 Pamula et al.
7,641,779 B2 1/2010 Becker et al.
7,727,466 B2 6/2010 Meathrel et al.
7,727,723 B2 6/2010 Pollack et al.
7,759,132 B2 7/2010 Pollack et al.
7,763,471 B2 7/2010 Pamula et al.
7,815,871 B2 10/2010 Pamula et al.
7,816,121 B2 10/2010 Pollack et al.
7,822,510 B2 10/2010 Paik et al.
7,851,184 B2 12/2010 Pollack et al.
7,875,160 B2 1/2011 Jary
7,901,947 B2 3/2011 Pollack et al.
7,919,330 B2 4/2011 De Guzman et al.
7,922,886 B2 4/2011 Fouillet et al.
7,939,021 B2 5/2011 Smith et al.
7,943,030 B2 5/2011 Shenderov
7,989,056 B2 8/2011 Plissonnier et al.
7,998,436 B2 8/2011 Pollack
8,007,739 B2 8/2011 Pollack et al.
8,041,463 B2 10/2011 Pollack et al.
8,048,628 B2 11/2011 Pollack et al.
8,075,754 B2 12/2011 Sauter-Starace et al.
8,088,578 B2 1/2012 Hua et al.
8,089,013 B2 * 1/2012 Steckl et al. ..... 200/182
8,093,062 B2 1/2012 Winger et al.
8,093,064 B2 1/2012 Shah et al.
8,137,917 B2 3/2012 Pollack et al.
8,147,668 B2 4/2012 Pollack et al.
8,202,686 B2 6/2012 Pamula et al.
8,208,146 B2 6/2012 Srinivasan et al.
8,221,605 B2 7/2012 Pollack et al.
8,236,156 B2 8/2012 Sarrut et al.
8,268,246 B2 9/2012 Srinivasan et al.
8,287,711 B2 10/2012 Pollack et al.
8,304,253 B2 11/2012 Yi et al.
8,313,698 B2 11/2012 Pollack et al.
8,317,990 B2 11/2012 Pamula et al.
8,342,207 B2 1/2013 Raccurt et al.
8,349,276 B2 1/2013 Pamula et al.
8,364,315 B2 1/2013 Sturmer et al.
8,388,909 B2 3/2013 Pollack et al.
8,389,297 B2 3/2013 Pamula et al.
8,394,249 B2 3/2013 Pollack et al.
8,426,213 B2 4/2013 Eckhardt et al.
8,440,392 B2 5/2013 Pamula et al.
8,444,836 B2 5/2013 Fouillet et al.
2002/0005354 A1 1/2002 Spence et al.
2002/0036139 A1 3/2002 Becker et al.
2002/0043463 A1 4/2002 Shenderov
2002/0058332 A1 5/2002 Quake et al.
2002/0143437 A1 10/2002 Handique et al.
2003/0164295 A1 9/2003 Sterling
2003/0183525 A1 10/2003 Elrod et al.
2003/0205632 A1 11/2003 Kim et al.
2004/0031688 A1 2/2004 Shenderov
2004/0055536 A1 3/2004 Kolar et al.
2004/0055891 A1 3/2004 Pamula et al.
2004/0058450 A1 3/2004 Pamula et al.
2004/0231987 A1 11/2004 Sterling et al.
2006/0021875 A1 2/2006 Griffith et al.
2006/0054503 A1 3/2006 Pamula et al.
2006/0164490 A1 7/2006 Kim et al.
2006/0194331 A1 8/2006 Pamula et al.
2006/0226013 A1 10/2006 Decre et al.
2006/0231398 A1 10/2006 Sarrut et al.
2007/0023292 A1 2/2007 Kim et al.
2007/0037294 A1 2/2007 Pamula et al.
2007/0045117 A1 3/2007 Pamula et al.
2007/0064990 A1 3/2007 Roth
2007/0086927 A1 4/2007 Natarajan et al.
2007/0207513 A1 9/2007 Sorensen et al.
2007/0217956 A1 9/2007 Pamula et al.
2007/0241068 A1 10/2007 Pamula et al.
2007/0242105 A1 10/2007 Srinivasan et al.
2007/0242111 A1 10/2007 Pamula et al.
2007/0243634 A1 10/2007 Pamula et al.
2007/0267294 A1 11/2007 Shenderov
2007/0275415 A1 11/2007 Srinivasan et al.
2008/0006535 A1 1/2008 Paik et al.
2008/0038810 A1 2/2008 Pollack et al.
2008/0044893 A1 2/2008 Pollack et al.
2008/0044914 A1 2/2008 Pamula et al.
2008/0050834 A1 2/2008 Pamula et al.
2008/0053205 A1 3/2008 Pollack et al.
2008/0105549 A1 5/2008 Pamela et al.
2008/0124252 A1 5/2008 Marchand et al.
2008/0142376 A1 6/2008 Fouillet et al.
2008/0151240 A1 6/2008 Roth
2008/0210558 A1 9/2008 Sauter-Starace et al.
2008/0247920 A1 10/2008 Pollack et al.
2008/0264797 A1 10/2008 Pamula et al.
2008/0274513 A1 11/2008 Shenderov et al.
2008/0281471 A1 11/2008 Smith et al.
2008/0283414 A1 11/2008 Monroe et al.
2008/0302431 A1 12/2008 Marchand et al.
2008/0305481 A1 12/2008 Whitman et al.
2009/0014394 A1 1/2009 Yi et al.
2009/0042319 A1 2/2009 De Guzman et al.
2009/0127123 A1 5/2009 Raccurt et al.
2009/0134027 A1 5/2009 Jary
2009/0142564 A1 6/2009 Plissonnier et al.
2009/0155902 A1 6/2009 Pollack et al.
2009/0192044 A1 7/2009 Fouillet
2009/0260988 A1 10/2009 Pamula et al.
2009/0263834 A1 10/2009 Sista et al.
2009/0280251 A1 11/2009 De Guzman et al.
2009/0280475 A1 11/2009 Pollack et al.
2009/0280476 A1 11/2009 Srinivasan et al.
2009/0283407 A1 11/2009 Shah et al.
2009/0288710 A1 11/2009 Viovy et al.
2009/0291433 A1 11/2009 Pollack et al.
2009/0304944 A1 12/2009 Sudarsan et al.
2009/0311713 A1 12/2009 Pollack et al.
2009/0321262 A1 12/2009 Adachi et al.
2010/0025242 A1 2/2010 Pamula et al.
2010/0025250 A1 2/2010 Pamula et al.
2010/0028920 A1 2/2010 Eckhardt
2010/0032293 A1 2/2010 Pollack et al.
2010/0041086 A1 2/2010 Pamula et al.
2010/0048410 A1 2/2010 Shenderov et al.
2010/0062508 A1 3/2010 Pamula et al.
2010/0068764 A1 3/2010 Sista et al.
2010/0087012 A1 4/2010 Shenderov et al.
2010/0096266 A1 4/2010 Kim et al.
2010/0116640 A1 5/2010 Pamula et al.
2010/0118307 A1 5/2010 Srinivasan et al.
2010/0120130 A1 5/2010 Srinivasan et al.
2010/0126860 A1 5/2010 Srinivasan et al.
2010/0130369 A1 5/2010 Shenderov et al.
2010/0140093 A1 6/2010 Pamula et al.
2010/0143963 A1 6/2010 Pollack
2010/0151439 A1 6/2010 Pamula et al.
2010/0184810 A1 7/2010 Sudarsan et al.
2010/0190263 A1 7/2010 Srinivasan et al.
2010/0194408 A1 8/2010 Sturmer et al.
2010/0221713 A1 9/2010 Pollack et al.
2010/0236927 A1 9/2010 Pope et al.
2010/0236928 A1 9/2010 Srinivasan et al.
2010/0236929 A1 9/2010 Pollack et al.
2010/0258441 A1 10/2010 Sista et al.
2010/0270156 A1 10/2010 Srinivasan et al.
2010/0279374 A1 11/2010 Sista et al.
2010/0282608 A1 11/2010 Srinivasan et al.
2010/0282609 A1 11/2010 Pollack et al.
2010/0307917 A1 12/2010 Srinivasan et al.
2010/0320088 A1 12/2010 Fouillet et al.
2010/0323405 A1 12/2010 Pollack et al.
2011/0076692 A1 3/2011 Sista et al.
2011/0086377 A1 4/2011 Thwar et al.

(56) References Cited

U.S. PATENT DOCUMENTS

| | | | |
|---|---|---|---|
| 2011/0091989 | A1 | 4/2011 | Sista et al. |
| 2011/0097763 | A1 | 4/2011 | Pollack et al. |
| 2011/0100823 | A1 | 5/2011 | Pollack et al. |
| 2011/0104725 | A1 | 5/2011 | Pamula et al. |
| 2011/0104747 | A1 | 5/2011 | Pollack et al. |
| 2011/0104816 | A1 | 5/2011 | Pollack et al. |
| 2011/0114490 | A1 | 5/2011 | Pamula et al. |
| 2011/0118132 | A1 | 5/2011 | Winger et al. |
| 2011/0147215 | A1 | 6/2011 | Fuchs et al. |
| 2011/0180571 | A1 | 7/2011 | Srinivasan et al. |
| 2011/0186433 | A1 | 8/2011 | Pollack et al. |
| 2011/0203930 | A1 | 8/2011 | Pamula et al. |
| 2011/0209998 | A1 | 9/2011 | Shenderov |
| 2011/0213499 | A1 | 9/2011 | Sturmer et al. |
| 2011/0303542 | A1 | 12/2011 | Srinivasan et al. |
| 2011/0311980 | A1 | 12/2011 | Pollack et al. |
| 2012/0044299 | A1 | 2/2012 | Winger |
| 2012/0132528 | A1 | 5/2012 | Shenderov et al. |
| 2012/0165238 | A1 | 6/2012 | Pamula et al. |

FOREIGN PATENT DOCUMENTS

| | | | |
|---|---|---|---|
| WO | 2004029585 | A1 | 4/2004 |
| WO | 2004030820 | | 4/2004 |
| WO | 2005047696 | A1 | 5/2005 |
| WO | 2006013303 | A1 | 2/2006 |
| WO | 2006070162 | A1 | 7/2006 |
| WO | 2006081558 | | 8/2006 |
| WO | 2006124458 | A2 | 11/2006 |
| WO | 2006127451 | A2 | 11/2006 |
| WO | 2006134307 | A1 | 12/2006 |
| WO | 2006138543 | | 12/2006 |
| WO | 2007003720 | A1 | 1/2007 |
| WO | 2007012638 | A1 | 2/2007 |
| WO | 2007033990 | A1 | 3/2007 |
| WO | 2007048111 | | 4/2007 |
| WO | 2007120240 | A2 | 10/2007 |
| WO | 2007120241 | A2 | 10/2007 |
| WO | 2007123908 | A2 | 11/2007 |
| WO | 2008051310 | A2 | 5/2008 |
| WO | 2008055256 | A3 | 5/2008 |
| WO | 2008068229 | A1 | 6/2008 |
| WO | 2008091848 | A2 | 7/2008 |
| WO | 2008098236 | A2 | 8/2008 |
| WO | 2008101194 | A2 | 8/2008 |
| WO | 2008106678 | A1 | 9/2008 |
| WO | 2008109664 | A1 | 9/2008 |
| WO | 2008112856 | A1 | 9/2008 |
| WO | 2008116209 | A1 | 9/2008 |
| WO | 2008116221 | A1 | 9/2008 |
| WO | 2008118831 | A2 | 10/2008 |
| WO | 2008124846 | A2 | 10/2008 |
| WO | 2008131420 | A2 | 10/2008 |
| WO | 2008134153 | A1 | 11/2008 |
| WO | 2009002920 | A1 | 12/2008 |
| WO | 2009003184 | A1 | 12/2008 |
| WO | 2009011952 | A1 | 1/2009 |
| WO | 2009021173 | A1 | 2/2009 |
| WO | 2009021233 | A2 | 2/2009 |
| WO | 2009026339 | A2 | 2/2009 |
| WO | 2009029561 | A2 | 3/2009 |
| WO | 2009032863 | A2 | 3/2009 |
| WO | 2009052095 | A1 | 4/2009 |
| WO | 2009052123 | A2 | 4/2009 |
| WO | 2009052321 | A2 | 4/2009 |
| WO | 2009052345 | | 4/2009 |
| WO | 2009052348 | A2 | 4/2009 |
| WO | 2009076414 | | 6/2009 |
| WO | 2009086403 | A2 | 7/2009 |
| WO | 2009111769 | A2 | 9/2009 |
| WO | 2009135205 | A2 | 11/2009 |
| WO | 2009137415 | A2 | 11/2009 |
| WO | 2009140373 | A2 | 11/2009 |
| WO | 2009140671 | A2 | 11/2009 |
| WO | 2010004014 | A1 | 1/2010 |
| WO | 2010006166 | A2 | 1/2010 |
| WO | 2010009463 | A2 | 1/2010 |
| WO | 2010019782 | A2 | 2/2010 |
| WO | 2010027894 | A3 | 3/2010 |
| WO | 2010042637 | A2 | 4/2010 |
| WO | 2010077859 | A3 | 7/2010 |
| WO | 2011002957 | A2 | 1/2011 |
| WO | 2011020011 | A2 | 2/2011 |
| WO | 2011057197 | A2 | 5/2011 |
| WO | 2011084703 | A2 | 7/2011 |
| WO | 2011126892 | A2 | 10/2011 |
| WO | 2012009320 | A2 | 1/2012 |
| WO | 2012012090 | A2 | 1/2012 |
| WO | 2012037308 | A2 | 3/2012 |

OTHER PUBLICATIONS

Pollack et al., "Electrowetting-Based Actuation of Droplets for Integrated Microfluidics," Lab on a Chip (LOC), vol. 2, pp. 96-101, 2002.

Benton, et al., "Library Preparation Method 1 DNA Library Construction for Illumine SBS Sequencing Platforms using NEBNext® Library Preparation Reagents", Application Note, NuGEN, 2011.

Boles, et al., "Droplet-Based Pyrosequencing Using Digital Microfluidics", Analytical Chemistry, vol. 83, Sep. 2011, 8439-47.

Bottausci, et al., "Fully Integrated EWOD Based Bio-Analysis Device", Labautomation 2011, Palm Springs Convention Center, Palm Springs, CA, USA; Abstract in Proceedings on line, poster distributed, Jan. 29-Feb. 2, 2011.

Burde, S et al., "Digital Microfluidic Rapid HIV Point-of-Care Diagnostic Device for Resource Limited Settings", Workshop on TB and HIV Diagnostics, Silver Spring, MD. (Poster, copies distributed to attendees.) http://www.blsmeetings.net/TB-HIV-Dx-Wkshop/index.cfm, Jun. 28, 2011.

Burton, et al., "Diagnosis of Fabry and Gaucher diseases from the Pilot Screening of Newborns for Lysosomal Storage Disorders in Illinois", APHL Newborn Screening and Genetic Testing Symposium, San Diego, 2011.

Chakrabarty, , "Automated Design of Microfluidics-Based Biochips: connecting Biochemistry of Electronics CAD", IEEE International Conference on Computer Design, San Jose, CA, Oct. 1-4, 2006, 93-100.

Chakrabarty, et al., "Design Automation Challenges for Microfluidics-Based Biochips", DTIP of MEMS & MOEMS, Montreux, Switzerland, Jun. 1-3, 2005.

Chakrabarty, et al., "Design Automation for Microfluidics-Based Biochips", ACM Journal on Engineering Technologies in Computing Systems , 1(3), 2005, 186-223.

Chakrabarty, K , "Design, Testing, and Applications of Digital Microfluidics-Based Biochips", Proceedings of the 18th International Conf. on VLSI held jointly with 4th International Conf. on Embedded Systems Design (VLSID'05), IEEE, 2005.

Cotten, et al., "Digital Microfluidics: a novel platform for multiplexed detection of lysosomal storage diseases", Abstract # 3747.9. Pediatric Academic Society Conference, 2008.

Delapierre, , "SmartDrop: An Integrated System from Sample Collection to Result using real-time PCR", 4th National Bio-Threat Conference, New Orleans, LA, USA; Abstract, Dec. 7-9, 2010.

Delapierre, et al., "SmartDrop: An Integrated System from Sample Collection to Result using real-time PCR", 4th National Bio-Threat Conference, New Orleans, LA, USA; Poster presented at conference, Dec. 7-9, 2010.

Delattre, , Movie in news on TF1 (at 12'45" Cyril Delattre), http://videos.tf1.fr/jt-we/zoom-sur-grenoble-6071525.html, 2009.

Delattre, , Movie in talk show "C Dans l'air" (at 24" Cyril Delattre), http://www.france5.fr/c-dans-l-air/sante/bientot-vous-ne-serez-plus-malade-31721, 2009.

Delattre, , Movie on Web TV—Cite des sciences (at 3'26" Cyril Delattre), http://www.universcience.tv/video-laboratoire-de-poche-793.html, 2009.

Delattre, et al., "SmartDrop: an integrated system from sample preparation to analysis using real-time PCR", 10th International Symposium on Protection against Chemical Biological Warefare Agents; Stockholm, Sweden; poster, Jun. 10, 2010.

(56) References Cited

OTHER PUBLICATIONS

Delattre, et al., "SmartDrop: An integrated system from sample preparation to analysis using real-time PCR", 10th International Symposium on Protection against Chemical and Biological Warefare Agents; Stockholm, Sweden; Abstract,paper,, Jun. 8-11, 2010.
Delattre, et al., "Towards an industrial fabrication process for electrowetting chip using standard MEMS Technology", µTAS2008, San Diego; poster presented, Oct. 15, 2008.
Delattre, et al., "Towards an industrial fabrication process for electrowetting chip using standard MEMS Technology", µTAS2008, San Diego; Abstract in proceedings, Oct. 13-16, 2008, 1696-1698.
Dewey, , "Towards a Visual Modeling Approach to Designing Microelectromechanical System Transducers", Journal of Micromechanics and Microengineering, vol. 9, Dec. 1999, 332-340.
Dewey, et al., "Visual modeling and design of microelectromechanical system tansducers", Microelectronics Journal, vol. 32, Apr. 2001, 373-381.
Eckhardt, et al., "Development and validation of a single-step fluorometric assay for Hunter syndrome", APHL Newborn Screening and Genetic Testing Symposium, San Diego, 2011.
Emani, et al., "Novel Microfluidic Platform for Point of Care Hypercoagulability Panel Testing", Circulation, vol. 122, 2010, A14693.
Fair, et al., "A Micro- Watt Metal-Insulator-Solution-Transport (MIST) Device for Scalable Digital Bio-Microfluidic Systems", IEEE IEDM Technical Digest, 2001, 16.4.1-4.
Fair, et al., "Advances in droplet-based bio lab-on-a-chip", BioChips 2003, Boston, 2003.
Fair, et al., "Bead-Based and Solution-Based Assays Performed on a Digital Microfluidic Platform", Biomedical Engineering Society (BMES) Fall Meeting, Baltimore, MD, Oct. 1, 2005.
Fair, , "Biomedical Applications of Electrowetting Systems", 5th International Electrowetting Workshop, Rochester, NY, 2006.
Fair, et al., "Chemical and Biological Applications of Digital-Microfluidic Devices", IEEE Design & Test of Computers, vol. 24(1), Jan.-Feb. 2007, 10-24.
Fair, et al., "Chemical and biological pathogen detection in a digital microfluidic platform", DARPA Workshop on Microfluidic Analyzers for DoD and National Security Applications, Keystone, CO, 2006.
Fair, , "Digital microfluidics: is a true lab-on-a-chip possible?", Microfluid Nanofluid, vol. 3, 2007, 245-281.
Fair, , "Droplet-based microfluidic DNA sequencing", NHGRI PI's meeting, Boston, 2005.
Fair, et al., "Electrowetting-based On-Chip Sample Processing for Integrated Microfluidics", IEEE Inter. Electron Devices Meeting (IEDM), 2003, 32.5.1-32.5.4.
Fair, et al., "Integrated chemical/biochemical sample collection, pre-concentration, and analysis on a digital microfluidic lab-on-a-chip platform", Lab-on-a-Chip: Platforms, Devices, and Applications, Conf. 5591, SPIE Optics East, Philadelphia, Oct. 25-28, 2004.
Fair, , "Scaling of Digital Microfluidic Devices for Picoliter Applications", The 6th International Electrowetting Meeting, Aug. 20-22, 2008.
Fouillet, , "Bio-Protocol Integration in Digital Microfluidic Chips", The 6th International Electrowetting Meeting, Aug. 20-22, 2008.
Fouillet, et al., "Design and Validation of a Complex Generic Fluidic Microprocessor Based on EWOD Droplet for Biological Applications", 9th International Conference on Miniaturized Systems for Chem and Life Sciences, Boston, MA, Oct. 9-13, 2005, 58-60.
Fouillet, et al., "Digital microfluidic design and optimization of classic and new fluidic functions for lab on a chip systems", Microfluid Nanofluid, vol. 4, 2008, 159-165.
Graham, et al., "Development of Quality Control Spots for Lysosomal Storage Disorders under cGMP", APHL Newborn Screening and Genetic Testing Symposium, San Diego, 2011.
Hua, et al., "Multiplexed real-time polymerase chain reaction on a digital microfluidic platform", Analytical Chemistry, vol. 82, No. 6, Mar. 15, 2010, Published on Web, Feb. 12, 2010, 2310-2316.
Hua, et al., "Rapid Detection of Methicillin-Resistant *Staphylococcus aureus* (MRSA) Using Digital Microfluidics", Proc. µTAS, 2008.
Jary, et al., "Development of complete analytical system for Environment and homeland security", 14th International Conference on Biodetection Technologies 2009, Technological Responses to Biological Threats, Baltimore, MD; Abstract in Proceedings, poster distributed at conference, Jun. 25-26, 2009, 663.
Jary, et al., "SmartDrop, Microfluidics for Biology", Forum 4i 2009, Grenoble, France; Flyer distributed at booth, May 14, 2009.
Jinks, et al., "Newborn Screening for Krabbe and other Lysosomal Storage Diseases", The 3rd Annual Workshop on Krabbe Disease, Java Center, New York, Jul. 19-21, 2010.
Kleinert, et al., "Electric Field Assisted Convective Assembly of Colloidal Crystal Coatings", Symposium MM: Evaporative Self Assembly of Polymers, Nanoparticles, and DNA, 2010 MRS Spring Meeting, San Francisco, CA., Apr. 6-8, 2010.
Kleinert, et al., "Electric Field-Assisted Convective Assembly of Large-Domain Colloidal Crystals", The 82nd Colloid & Surface Science Symposium, ACS Division of Colloid & Surface Science, North Carolina State University, Raleigh, NC. www.colloids2008.org., Jun. 15-18, 2008.
Kleinert, , "Electric-Field-Assisted Convective Assembly of Colloidal Crystal Coatings", Langmuir, vol. 26(12), 2010, 10380-10385.
Malk, R. et al., "EWOD in coplanar electrode configurations", Proceedings of ASME 2010 3rd Joint US-European Fluids Engineering Summer Meeting and 8th International Conference on Nanochannels, Microchannels, and Minichannels, http://asmedl.org/getabs/servlet/GetabsServlet?prog=normal &id=ASMECP0020100545010002390000001, 2010.
Marchand, et al., "Organic Synthesis in Soft Wall-Free Microreactors: Real-Time Monitoring of Fluorogenic Reactions", Analytical Chemistry, vol. 80, 2008, 6051-6055.
Millington, et al., "Digital microfluidics: a future technology in the newborn screening laboratory", Seminars in Perinatology, vol. 34, Apr. 2010, 163-169.
Millington, et al., "Digital Microfluidics: a novel platform for multiplexed detection of LSDs with potential for newborn screening", Association of Public Health Laboratories Annual Conference, San Antonio, TX, Nov. 4, 2008.
Millington, et al., "Digital Microfluidics: A Novel Platform for Multiplexing Assays Used in Newborn Screening", Proceedings of the 7th International and Latin American Congress. Oral Presentations. Rev Invest Clin; vol. 61 (Supl. 1), 2009, 21-33.
Paik, et al., "A digital-microfluidic approach to chip cooling", IEEE Design & Test of Computers, vol. 25, Jul. 2008, 372-381.
Paik, et al., "Active cooling techniques for integrated circuits", IEEE Transactions on VLSI, vol. 16, No. 4, 2008, 432-443.
Paik, , et al., "Adaptive Cooling of Integrated Circuits Using Digital Microfluidics", accepted for publication in IEEE Transactions on VLSI Systems, 2007, and Artech House, Norwood, MA, 2007.
Paik, , "Adaptive Hot-Spot Cooling of Integrated Circuits Using Digital Microfluidics", Dissertation, Dept. of Electrical and Computer Engineering, Duke University, Apr. 25, 2006, 1-188.
Paik, et al., "Adaptive hot-sport cooling of integrated circuits using digital microfluidics", Proceedings ASME International Mechanical Engineering Congress and Exposition, Orlando, Florida, USA. IMECE2005-81081, Nov. 5-11, 2005, 1-6.
Paik, et al., "Coplanar Digital Microfluidics Using Standard Printed Circuit Board Processes", 9th International Conference on Miniaturized Systems for Chemistry and Life Sciences (MicroTAS), Boston, MA; Poster, 2005.
Paik, et al., "Coplanar Digital Microfluidics Using Standard Printed Circuit Board Processes", 9th Int'l Conf. on Miniaturized Systems for Chemistry and Life Sciences, Boston, MA, Oct. 9-13, 2005, 566-68.
Paik, et al., "Droplet-Based Hot Spot Cooling Using Topless Digital Microfluidics on a Printed Circuit Board", Int'l Workshops on Thermal Investigations of ICs and Systems (THERMINIC), 2005, 278-83.
Paik, et al., "Electrowetting-based droplet mixers for microfluidic systems", Lab on a Chip (LOC), vol. 3. (more mixing videos available, along with the article, at LOC's website), 2003, 28-33.

(56) References Cited

OTHER PUBLICATIONS

Paik, et al., "Heat Transfer Analysis for Adaptive Hot-Spot Cooling of Integrated Circuits using Digital Microfluidics", ASME's IMECE, 2005.
Paik, et al., "Programmable Flow-Through Real Time PCR Using Digital Microfluidics", 11th International Conference on Miniaturized Systems for Chemistry and Life Sciences, Paris, France, Oct. 7-11, 2007, 1559-1561.
Paik, et al., "Programmable flow-through real-time PCR using digital microfluidics", Proc. Micro Total Analysis Systems (μpTAS), Handout, 2007.
Paik, et al., "Programmable flow-through real-time PCR using digital microfluidics", Proc. Micro Total Analysis Systems (μTAS), Poster, 2007.
Paik, et al., "Rapid Droplet Mixers for Digital Microfluidic Systems", Masters Thesis, Duke Graduate School., 2002, 1-82.
Paik, et al., "Rapid droplet mixers for digital microfluidic systems", Lab on a Chip, vol. 3. (More mixing videos available, along with the article, at LOC's website.), 2003, 253-259.
Paik, et al., "Thermal effects on Droplet Transport in Digital Microfluids with Application to Chip Cooling Processing for Integrated Microfluidics", International Conference on Thermal, Mechanics, and Thermomechanical Phenomena in Electronic Systems (ITherm), 2004, 649-654.
Pamula, , "A digital microfluidic platform for multiplexed explosive detection", Chapter 18, Electronics Noses and Sensors for the Detection of Explosives, Eds., J.W. Gardner and J. Yinon, Kluwer Academic Publishers, 2004.
Pamula, et al., "A droplet-based lab-on-a-chip for colorimetric detection of nitroaromatic explosives", Proceedings of Micro Electro Mechanical Systems, 2005, 722-725.
Pamula, et al., "Cooling of integrated circuits using droplet-based microfluidics", Proc. ACM Great Lakes Symposium on VLSI, Apr. 2003, 84-87.
Pamula, , "Digital microfluidic lab-on-a-chip for multiplexing tests in newborn screening", Newborn Screening Summit: Envisioning a Future for Newborn Screening, Bethesda, MD, Dec. 7, 2009.
Pamula, et al., "Digital microfluidic lab-on-a-chip for protein crystallization", 5th Protein Structure Initiative "Bottlenecks" Workshop, NIH, Bethesda, MD, Apr. 13-14, 2006, I-16.
Pamula, et al., "Digital Microfluidic Methods in Diagnosis of Neonatal Biochemical Abnormalities", Developing Safe and Effective Devices and Instruments for Use in the Neonatal Intensive Care for the 21st Century, Pediatric Academic Societies' Annual Meeting, Vancouver, Canada, 2010.
Pamula, et al., "Digital Microfluidic Platform for Multiplexing LSD Assays in Newborn Screening", LSD World Meeting, Las Vegas, NV, Feb. 16-18, 2011.
Pamula, et al., "Digital Microfluidics Platform for Lab-on-a-chip applications", Duke University Annual Post Doctoral Research Day, 2002.
Pamula, et al., "Microfluidic electrowetting-based droplet mixing", IEEE, 2002, 8-10.
Pamula, et al., "Microfluidic electrowetting-based droplet mixing", Proceedings, MEMS Conference Berkeley, Aug. 24-26, 2001, 8-10.
Pamula, , "Sample Preparation and Processing using Magnetic Beads on a Digital Microfluidic Platform", CHI's Genomic Sample Prep, San Francisco, CA, Jun. 9-10, 2009.
Pamula, , "Sample-to-sequence-molecular diagnostics on a digital microfluidic lab on a chip", Pre-conference workshops, 4th International Conference on Birth Defects and Disabilities in the Developing World, New Dehli, India, Oct. 4, 2009.
Pamula and Chakrabarty (Co-Chair, "Digital Microfluidics for Lab-on-a-Chip Applications", "Emerging CAD Challenges for Biochip Design" Workshop, Conference on Design, Automation, and Test in Durope (Date), Munich, Germany, Advance Programme, 2005, pp. 85-87.
Pollack, et al., "Applications of Electrowetting-Based Digital Microfluidics in Clinical Diagnostics", Expert Rev. Mol. Diagn., vol. 11(4), 2011, 393-407.
Pollack, et al., "Continuous sequencing-by-synthesis-based on a digital microfluidic platform", National Human Genome Research Institute, Advanced DNA Sequencing Technology Development Meeting, Chapel Hill, NC, Mar. 10-11, 2010.
Pollack, et al., "Electrowetting-based actuation of liquid droplets for microfluidic applications", Appl. Phys. Letters, vol. 77, No. 11, Sep. 11, 2000, 1725-1726.
Pollack, , "Electrowetting-based Microactuation of Droplets for Digital Microfluidics", PhD Thesis, Department of Electrical and Computer Engineering, Duke University, 2001.
Pollack, et al., "Electrowetting-Based Microfluidics for High-Throughput Screening", smallTalk 2001 Conference Program Abstract, San Diego, Aug. 27-31, 2001, 149.
Pollack, et al., "Investigation of electrowetting-based microfluidics for real-time PCR applications", Proc. 7th Int'l Conference on Micro Total Analysis Systems (μTAS), Squaw Valley, CA, Oct. 5-9, 2003, 619-622.
Pollack, , "Lab-on-a-chip platform based digital microfluidics", The 6th International Electrowetting Meeting, Aug. 20-22, 2008.
Punnamaraju, , "Voltage and Photo Induced Effects in Droplet-Interface-Bilayer Lipid", PhD Thesis, University of Cincinnati, 2011.
Punnamaraju, et al., "Voltage Control of Droplet Interface Bilayer Lipid Membrane Dimensions", Langmuir The ACS Journal of Surfaces and Colloids, vol. 27, Issue 2, 2011, Published on Web, Dec. 10, 2010, 618-626.
Ren, et al., "Automated electrowetting-based droplet dispensing with good reproducibility", Proc. Micro Total Analysis Systems (mTAS), 7th Int. Conf.on Miniaturized Chem and Biochem Analysis Systems, Squaw Valley, CA, Oct. 5-9, 2003, 993-996.
Ren, et al., "Automated on-chip droplet dispensing with volume control by electro-etting actuation and capacitance metering", Sensors and Actuators B: Chemical, vol. 98, Mar. 2004, 319-327.
Ren, et al., "Design and testing of an interpolating mixing architecture for electrowetting-based droplet-on-chip chemical dilution", Transducers, 12th International Conference on Solid-State Sensors, Actuators and Microsystems, 2003, 619-622.
Ren, et al., "Dynamics of electro-wetting droplet transport", Sensors and Actuators B. (Chemical), vol. B87, No. 1, Nov. 15, 2002, 201-206.
Ren, et al., "Micro/Nana Liter Droplet Formation and Dispensing by Capacitance Metering and Electrowetting Actuation", IEEE-NANO, 2002, 369-372.
Rival, et al., "EWOD Digital Microfluidic Device for Single Cells Sample Preparation and Gene Expression Analysis", Lab Automation 2010, Palm Springs Convention Center, Palm Springs, CA, USA; Abstract in Proceedings, Poster distributed at conference, Jan. 23-27, 2010.
Rival, et al., "Expression de gènes de quelques cellules sur puce EWOD/Gene expression of few cells on EWOD chip", iRTSV,http://www-dsv.cea.fr/var/plain/storage/original/media/File/iRTSV/thema_08(2).pdf (english translation), Winter 2009-2010.
Rival, et al., "Towards Single Cells Gene Expression on EWOD Lab on Chip", ESONN 2008, Grenoble, France; Poster presented, Aug. 26, 2008.
Rival, et al., "Towards single cells gene expression on EWOD lab on chip", ESONN, Grenoble, France, abstract in proceedings, Aug. 2008.
Rival, et al., "Towards single cells gene expression preparation and analysis on ewod lab on chip", Nanobio Europe 2009, Poster distributed at conference, Jun. 16-18, 2009.
Rival, et al., "Towards single cells gene expression preparation and analysis on ewod lab on chip", Nanobio Europe 2009, Abstract in proceedings, Jun. 16-18, 2009.
Rival, et al., "Towards single cells gene expression preparation and analysis on ewod lab on chip", Lab on Chip Europe 2009 poster distributed at Conference, May 19-20, 2009.
Rival, et al., "Towards single cells gene expression preparation and analysis on ewod lab on chip", Lab on Chip Europe 2009 , Abstract in proceedings, May 19-20, 2009.
Rouse, et al., "Digital microfluidics: a novel platform for multiplexing assays used in newborn screening", Poster 47, 41st AACC's Annual Oak Ridge Conference Abstracts, Clinical Chemistry, vol. 55, 2009, 1891.

(56) References Cited

OTHER PUBLICATIONS

Shi, et al., "Evaluation of stability of fluorometric reagent kits for screening of Lysosomal Storage Disorders", APHL Newborn Screening and Genetic Testing Symposium, San Diego, 2011.
Sista, et al., "96-Immunoassay Digital Microfluidic Multiwell Plate", Proc. μTAS, 2008.
Sista, , "Development of a Digital Microfluidic Lab-on-a-Chip for Automated Immunoassays with Magnetically Responsive Beads", PhD Thesis, Department of Chemical Engineering, Florida State University, 2007.
Sista, et al., "Development of a digital microfluidic platform for point of care testing", Lab on a chip, vol. 8, Dec. 2008, First published as an Advance Article on the web, Nov. 5, 2008, 2091-2104.
Sista, et al., "Digital Microfluidic Platform for Multiplexing Enzyme Assays: Implications for Lysosomal Storage Disease Screening in Newborns", Clinical Chemistry, vol. 57, 2011, 1444-51.
Sista, et al., "Digital Microfluidic platform for multiplexing LSD assays in newborn screening", APHL Newborn Screening and Genetic Testing Symposium, Orlando, 2010.
Sista, et al., "Do Not Submit/Development of digital microfluidic assays for galactosemia and biotinidase deficiency in newborn dried blood spot samples", Not Yet Published/Extended abstract from the 2013 APHL Newborn Screening and Genetic Testing Symposium and the International Society for Neonatal Screening, Atlanta, GA, Extended abstract to be published summer 2013.
Sista, et al., "Heterogeneous immunoassays using magnetic beads on a digital microfluidic platform", Lab on a Chip, vol. 8, Dec. 2008, First published as an Advance Article on the web, Oct. 14, 2008, 2188-2196.
Sista, et al., "Performance of a digital microfluidic assay for Gaucher and Hurler disorders", APHL Newborn Screening and Genetic Testing Symposium, San Diego, 2011.
Sista, et al., "Rapid, Single-Step Assay for Hunter Syndrome in Dried Blood Spots Using Digital Microfluidics", Clinica Chimica Acta, vol. 412, 2011, 1895-97.
Sista, et al., "Spatial multiplexing of immunoassays for small-volume samples", 10th PI Meeting IMAT, Bethesda, 2009.
Srinivasan, et al., "3-D imaging of moving droplets for microfluidics using optical coherence tomography", Proc. 7th International Conference on Micro Total Analysis Systems (μTAS), Squaw Valley, CA, Oct. 5-9, 2003, 1303-1306.
Srinivasan, et al., "A digital microfluidic biosensor for multianalyte detection", Proc. IEEE 16th Annual Int'l Conf. on Micro Electro Mechanical Systems Conference, 2003, 327-330.
Srinivasan, , "A Digital Microfluidic Lab-on-a-Chip for Clinical Diagnostic Applications", Ph.D. thesis, Dept of Electrical and Computer Engineering, Duke University, 2005.
Srinivasan, et al., "An integrated digital microfluidic lab-on-a-chip for clinical diagnostics on human physiological fluids", Lab on a Chip, vol. 4, 2004, 310-315.
Srinivasan, et al., "Clinical diagnostics on human whole blood, plasma, serum, urine, saliva, sweat and tears on a digital microfluidic platform", Proc. 7th International Conference on Micro Total Analysis Systems (μTAS), Squaw Valley, CA, Oct. 5-9, 2003, 1287-1290.
Srinivasan, et al., "Digital Microfluidic Lab-on-a-Chip for Protein Crystallization", The 82nd ACS Colloid and Surface Science Symposium, 2008.
Srinivasan, et al., "Digital Microfluidics: a novel platform for multiplexed detection of lysosomal storage diseases for newborn screening", AACC Oak Ridge Conference Abstracts, Clinical Chemistry, vol. 54, 2008, 1934.
Srinivasan, et al., "Droplet-based microfluidic lab-on-a-chip for glucose detection", Analytica Chimica Acta, vol. 507, No. 1, 2004, 145-150.
Srinivasan, et al., "Electrowetting", Chapter 5, Methods in Bioengineering: Biomicrofabrication and Biomicrofluidics, Ed. J.D. Zahn, ISBN: 9781596934009, Artech House Publishers, 2010.
Srinivasan, et al., "Feasibility of a point of care newborn screening platform for hyperbilirubinemia", APHL Newborn Screening and Genetic Testing Symposium, San Diego, 2011.
Srinivasan, et al., "Low cost digital microfluidic platform for protein crystallization", Enabling Technologies for Structural Biology, NIGMS Workshop, Bethesda, MD., Mar. 4-6, 2009, J-23.
Srinivasan, et al., "Protein Stamping for MALDI Mass Spectrometry Using an Electrowetting-based Microfluidic Platform", Lab-on-a-Chip: Platforms, Devices, and Applications, Conf. 5591, SPIE Optics East, Philadelphia, Oct. 25-28, 2004.
Srinivasan, et al., "Scalable Macromodels for Microelectromechanical Systems", Technical Proc. 2001 Int. Conf. on Modeling and Simulation of Microsystems, 2001, 72-75.
Su, et al., "Yield Enhancement of Digital Microfluidics-Based Biochips Using Space Redundancy and Local Reconfiguration", Proc. Design, Automation and Test in Europe (Date) Conf., IEEE, 2005, 1196-1201.
Sudarsan, et al., "Printed circuit technology for fabrication of plastic based microfluidic devices", Analytical Chemistry vol. 76, No. 11, Jun. 1, 2004, Previously published on-line, May 2004, 3229-3235.
Thwar, et al., "DNA sequencing using digital microfluidics", Poster 42, 41st AACC's Annual Oak Ridge Conference Abstracts, Clinical Chemistry vol. 55, 2009, 1891.
Tolun, et al., "Dried blood spot based enzyme assays for lysosomal storage disorders", 2011 Tokyo Meeting on Lysosomal Storage Disease Screening, Tokyo, Aug. 5, 2011.
Wang, et al., "Comparison of enzyme activities for Pompe, Fabry, and Gaucher diseases on CDC's Quality Control spots between microplate fluorometry, mass spectrometry, and digital microfluidic fluorometry", APHL Newborn Screening and Genetic Testing Symposium, San Diego, 2011.
Wang, et al., "Droplet-based micro oscillating-flow PCR chip", J. Micromechanics and Microengineering, vol. 15, 2005, 1369-1377.
Wang, et al., "Efficient in-droplet separation of magnetic particles for digital microfluidics", Journal of Micromechanics and Microengineering, vol. 17, 2007, 2148-2156.
Wulff-Burchfield, et al., "Microfluidic platform versus conventional real-time polymerase chain reaction for the detection of *Mycoplasma pneumoniae* in respiratory specimens", Diagnostic Microbiology and Infectious Disease, vol. 67, 2010, 22-29.
Xu, et al., "A Cross-Referencing-Based Droplet Manipulation Method for High-Throughput and Pin-Constrained Digital Microfluidic Arrays", Proceedings of conference on Design, Automation and Test in Europe (Date ), Apr. 2007.
Xu, et al., "Automated Design of Pin-Constrained Digital Microfluidic Biochips Under Droplet-Interference Constraints", ACM Journal on Emerging Technologies is Computing Systems, vol. 3(3), 2007, 14:1-14:23.
Xu, et al., "Automated solution preparation on a digital microfluidic lab-on-chip", PSI Bottlenecks Workshop, 2008.
Xu, et al., "Automated, Accurate and Inexpensive Solution-Preparation on a Digital Microfluidic Biochip", Proc. IEEE Biomedical Circuits and Systems Conference (BioCAS), 2008, 301-304.
Xu, et al., "Defect-Aware Synthesis of Droplet-Based Microfluidic Biochips", IEEE, 20th International Conference on VLSI Design, 2007.
Xu, et al., "Defect-Tolerant Design and Optimization of a Digital Microfluidic Biochip for Protein Crystallization", IEEE Transactions on Computer Aided Design, vol. 29, No. 4, 2010, 552-565.
Xu, et al., "Design and Optimization of a Digital Microfluidic Biochip for Protein Crystallization", Proc. IEEE/ACM International Conference on Computer-Aided Design (ICCAD), Nov. 2008, 297-301.
XU, et al., "Digital Microfluidic Biochip Design for Protein Crystallization", IEEE-NIH Life Science Systems and Applications Workshop, LISA, Bethesda, MD, Nov. 8-9, 2007, 140-143.
Xu, et al., "Droplet-Trace-Based Array Partitioning and a Pin Assignment Algorithm for the Automated Design of Digital Microfluidic Biochips", CODES, 2006, 112-117.
XU, et al., "Integrated Droplet Routing in the Synthesis of Microfluidic Biochips", IEEE, 2007, 948-953.
Xu, et al., "Parallel Scan-Like Test and Multiple-Defect Diagnosis for Digital Microfluidic Biochips", IEEE Transactions on Biomedical Circuits and Systems, vol. 1(2), Jun. 2007, 148-158.

(56) References Cited

OTHER PUBLICATIONS

Xu, et al., "Parallel Scan-Like Testing and Fault Diagnosis Techniques for Digital Microfluidic Biochips", Proceedings of the 12th IEEE European Test Symposium (ETS), Freiburg, Germany, May 20-24, 2007, 63-68.
Xu, et al., "Same Reference as IDS 569 A Cross-Referencing-Based Droplet Manipulation Method for High-Throughput and Pin-Constrained Digital Microfluidic Arrays", IEEE, 2007.
Yang, et al., "Manipulation of droplets in microfluidic systems", Trends in Analytical Chemistry, vol. 29, Feb. 2010, 141-157.
Yi, et al., "Channel-to-droplet extractions for on-chip sample preparation", Solid-State Sensor, Actuators and Microsystems Workshop (Hilton Head '06), Hilton Head Island, SC, Jun. 2006, 128-131.
Yi, et al., "Characterization of electrowetting actuation on addressable single-side coplanar electrodes", Journal of Micromechanics and Microengineering, vol. 16.,Oct. 2006 http://dx.doi.org/10.1088/0960-1317/16/10/018, published online at stacks.iop.org/JMM/16/2053, Aug. 25, 2006, 2053-2059.
Yi, et al., "EWOD Actuation with Electrode-Free Cover Plate", Digest of Tech. papers, 13th International Conference on Solid-State Sensors, Actuators and Microsystems (Transducers '05), Seoul, Korea, Jun. 5-9, 2005, 89-92.
Yi, et al., "Geometric surface modification of nozzles for complete transfer of liquid drops", Solid-State Sensor, Actuator and Microsystems Workshop, Hilton Head Island, South Carolina, Jun. 6-10, 2004, 164-167.
Yi, , "Soft Printing of Biofluids for Micro-arrays: Concept, Principle, Fabrication, and Demonstration", Ph.D. dissertation, UCLA, 2004.
Yi, et al., "Soft Printing of Droplets Digitized by Electrowetting", Transducers 12th Int'l. Conf. on Solid State Sensors, Actuators and Microsystems, Boston, Jun. 8-12, 2003, 1804-1807.
Yi, et al., "Soft Printing of Droplets Pre-Metered by Electrowetting", Sensors and Actuators A: Physical, vol. 114, Jan. 2004, 347-354.
Zeng, et al., "Actuation and Control of Droplets by Using Electrowetting-on-Dielectric", Chin. Phys. Lett., vol. 21(9), 2004, 1851-1854.
Zhao, et al., "Droplet Manipulation and Microparticle Sampling on Perforated Microfilter Membranes", J. Micromech. Microeng., vol. 18, 2008, 1-11.
Zhao, et al., "In-droplet particle separation by travelling wave dielectrophoresis (twDEP) and EWOD", Solid-State Sensor, Actuators and Microsystems Workshop (Hilton Head '06), Hilton Head Island, SC, Jun. 2006, 181-184.
Zhao, et al., "Micro air bubble manipulation by electrowetting on dielectric (EWOD): transporting, splitting, merging and eliminating of bubbles", Lab on a chip, vol. 7, 2007, First published as an Advance Article on the web, Dec. 4, 2006, 273-280.
Zhao, et al., "Microparticle Concentration and Separation byTraveling-Wave Dielectrophoresis (twDEP) for Digital Microfluidics", J. Microelectromechanical Systems, vol. 16, No. 6, Dec. 2007, 1472-1481.
Zhao, et al., "Synchronization of Concurrently-Implemented Fluidic Operations in Pin-Constrained Digital Microfluidic Biochips", VLSI Design, (Best Paper Award), 2010.

* cited by examiner

DROPLET ACTUATOR DEVICES AND METHODS

1 RELATED APPLICATIONS

In addition to the patent applications cited herein, each of which is incorporated herein by reference, this application is a continuation in part of and incorporates by reference International Patent Application Ser. No. PCT/US2010/040705, entitled "Droplet Actuator Devices and Methods" International filing date of Jul. 1, 2010, the application of which is related to and claims priority to U.S. Provisional Patent Application Nos. 61/234,114, filed on Aug. 14, 2009, entitled "Droplet Actuator with Conductive Ink Ground"; 61/294,874, filed on Jan. 14, 2010, entitled "Droplet Actuator with Conductive Ink Ground"; the entire disclosures of which are incorporated herein by reference.

In addition, this application is related to and claims priority to U.S. Provisional Patent Application No. 61/384,870, filed on Sep. 21, 2010, entitled "Droplet Actuator with Conductive Ink Electrodes and/or Ground Planes," the entire disclosure of which are incorporated herein by reference.

2 FIELD OF THE INVENTION

The invention generally relates to microfluidic systems. In particular, the invention is directed to droplet actuator devices for and methods of facilitating certain droplet actuated molecular techniques.

3 BACKGROUND OF THE INVENTION

Droplet actuators are used to conduct a wide variety of droplet operations. A droplet actuator typically includes one or more substrates configured to form a surface or gap for conducting droplet operations. The one or more substrates include electrodes for conducting droplet operations. The gap between the substrates is typically filled or coated with a filler fluid that is immiscible with the liquid that is to be subjected to droplet operations. Droplet operations are controlled by electrodes associated with the one or more substrates. Current designs of droplet actuators may have certain drawbacks, as follows. The substrates of a droplet actuator typically include electrodes and/or an electrical ground plane patterned thereon that are exposed to the droplet operations gap. The materials and/or processes for forming the electrodes and/or electrical ground planes may be costly. Consequently, there is a need for less costly materials and/or processes for forming the electrodes and/or electrical ground planes of droplet actuators.

4 BRIEF DESCRIPTION OF THE INVENTION

The invention provides a layered substrate. The layered substrate may include a base substrate; an electrically conductive element comprising a conductive ink layer on the base substrate; and a hydrophobic layer overlying at least a portion of the conductive ink layer on the base substrate. The layered substrate may include a droplet on the hydrophobic layer. The layered substrate may include an oil filler fluid on the hydrophobic layer. The electrically conductive element comprising a conductive ink layer on the base substrate may be patterned to form an electrode in an array of electrodes. The electrically conductive element comprising a conductive ink layer on the base substrate may include electrowetting electrodes.

The conductive ink may include a PEDOT ink. The conductive ink may include a PEDOT:PSS ink. The conductive ink may include a PEDOT ink and the hydrophobic layer may include a CYTOP coating. The conductive ink may include a PEDOT:PSS ink and the hydrophobic layer may include a CYTOP coating. The conductive ink may include a PEDOT ink and the hydrophobic layer may include a fluoropolymer coating. The conductive ink may include a PEDOT:PSS ink and the hydrophobic layer may include a fluoropolymer coating. The conductive ink may include a PEDOT ink and the hydrophobic layer may include an amorphous fluoropolymer coating. The conductive ink may include a PEDOT:PSS ink and the hydrophobic layer may include an amorphous fluoropolymer coating. The conductive ink layer may include a poly(3,4-ethylenedioxythiophene)-poly(styrenesulfonate) material. The conductive ink layer may include at least one of CLEVOS P Jet N, CLEVOS P Jet HC, CLEVOS P Jet N V2 and CLEVOS P Jet HC V2.

The invention provides a microfluidic device made using the layered substrate. The microfluidic device may include a second substrate separated from the layered substrate to provide a gap between the layered substrate and the second substrate. The second substrate may include: an electrically conductive element comprising a conductive ink layer on the second substrate facing the gap; and a hydrophobic layer overlying at least a portion of the conductive ink layer on the second substrate. The microfluidic device may include a droplet in the gap. The microfluidic device may include an oil filler fluid in the gap.

The base substrate may be formed using a material selected from the group consisting of silicon-based materials, glass, plastic and PCB. The base substrate may be formed of a material selected from the group consisting of glass, polycarbonate, COC, COP, PMMA, polystyrene and plastic.

The a dielectric layer may be disposed between the an electrically conductive element comprising a conductive ink layer on the base substrate and the hydrophobic layer overlying at least a portion of the conductive ink layer on the base substrate. The hydrophobic layer material may include a fluoropolymer.

The hydrophobic layer material may include an amorphous fluoropolymer. The hydrophobic layer material may include a polytetrafluoroethylene polymer. The base substrate is subject to a corona treatment prior to applying the conductive ink. The hydrophobic layer may include a CYTOP and the CYTOP is applied as a formulation in which the CYTOP is dissolved in a fluorinert solvent.

These and other embodiments will be apparent from the ensuing specification.

5 DEFINITIONS

As used herein, the following terms have the meanings indicated.

"Activate," with reference to one or more electrodes, means affecting a change in the electrical state of the one or more electrodes which, in the presence of a droplet, results in a droplet operation. Activation of an electrode can be accomplished using alternating or direct current. Any suitable voltage may be used.

"Droplet" means a volume of liquid on a droplet actuator. Typically, a droplet is at least partially bounded by a filler fluid. For example, a droplet may be completely surrounded by a filler fluid or may be bounded by filler fluid and one or more surfaces of the droplet actuator. As another example, a droplet may be bounded by filler fluid, one or more surfaces of the droplet actuator, and/or the atmosphere. As yet another example, a droplet may be bounded by filler fluid and the atmosphere. Droplets may, for example, be aqueous or non-aqueous or may be mixtures or emulsions including aqueous and non-aqueous components. Droplets may take a wide variety of shapes; nonlimiting examples include generally disc shaped, slug shaped, truncated sphere, ellipsoid, spherical, partially compressed sphere, hemispherical, ovoid, cylindrical, combinations of such shapes, and various shapes formed during droplet operations, such as merging or splitting or formed as a result of contact of such shapes with one or more surfaces of a droplet actuator. For examples of droplet fluids that may be subjected to droplet operations using the approach of the invention, see International Patent Application No. PCT/US 06/47486, entitled, "Droplet-Based Biochemistry," filed on Dec. 11, 2006. In various embodiments, a droplet may include a biological sample, such as whole blood, lymphatic fluid, serum, plasma, sweat, tear, saliva, sputum, cerebrospinal fluid, amniotic fluid, seminal fluid, vaginal excretion, serous fluid, synovial fluid, pericardial fluid, peritoneal fluid, pleural fluid, transudates, exudates, cystic fluid, bile, urine, gastric fluid, intestinal fluid, fecal samples, liquids containing single or multiple cells, liquids containing organelles, fluidized tissues, fluidized organisms, liquids containing multi-celled organisms, biological swabs and biological washes. Moreover, a droplet may include a reagent, such as water, deionized water, saline solutions, acidic solutions, basic solutions, detergent solutions and/or buffers. Other examples of droplet contents include reagents, such as a reagent for a biochemical protocol, such as a nucleic acid amplification protocol, an affinity-based assay protocol, an enzymatic assay protocol, a sequencing protocol, and/or a protocol for analyses of biological fluids. A droplet may include one or more beads.

"Droplet Actuator" means a device for manipulating droplets. For examples of droplet actuators, see Pamula et al., U.S. Pat. No. 6,911,132, entitled "Apparatus for Manipulating Droplets by Electrowetting-Based Techniques," issued on Jun. 28, 2005; Pamula et al., U.S. patent application Ser. No. 11/343,284, entitled "Apparatuses and Methods for Manipulating Droplets on a Printed Circuit Board," filed on filed on Jan. 30, 2006; Pollack et al., International Patent Application No. PCT/US2006/047486, entitled "Droplet-Based Biochemistry," filed on Dec. 11, 2006; Shenderov, U.S. Pat. No. 6,773,566, entitled "Electrostatic Actuators for Microfluidics and Methods for Using Same," issued on Aug. 10, 2004 and U.S. Pat. No. 6,565,727, entitled "Actuators for Microfluidics Without Moving Parts," issued on Jan. 24, 2000; Kim and/or Shah et al., U.S. patent application Ser. No. 10/343,261, entitled "Electrowetting-driven Micropumping," filed on Jan. 27, 2003, Ser. No. 11/275,668, entitled "Method and Apparatus for Promoting the Complete Transfer of Liquid Drops from a Nozzle," filed on Jan. 23, 2006, Ser. No. 11/460,188, entitled "Small Object Moving on Printed Circuit Board," filed on Jan. 23, 2006, Ser. No. 12/465,935, entitled "Method for Using Magnetic Particles in Droplet Microfluidics," filed on May 14, 2009, and Ser. No. 12/513,157, entitled "Method and Apparatus for Real-time Feedback Control of Electrical Manipulation of Droplets on Chip," filed on Apr. 30, 2009; Velev, U.S. Pat. No. 7,547,380, entitled "Droplet Transportation Devices and Methods Having a Fluid Surface," issued on Jun. 16, 2009; Sterling et al., U.S. Pat. No. 7,163,612, entitled "Method, Apparatus and Article for Microfluidic Control via Electrowetting, for Chemical, Biochemical and Biological Assays and the Like," issued on Jan. 16, 2007; Becker and Gascoyne et al., U.S. Pat. No. 7,641,779, entitled "Method and Apparatus for Programmable fluidic Processing," issued on Jan. 5, 2010, and U.S. Pat. No. 6,977,033, entitled "Method and Apparatus for Programmable fluidic Processing," issued on Dec. 20, 2005; Decre et al., U.S. Pat. No. 7,328,979, entitled "System for Manipulation of a Body of Fluid," issued on Feb. 12, 2008; Yamakawa et al., U.S. Patent Pub. No. 20060039823, entitled "Chemical Analysis Apparatus," published on Feb. 23, 2006; Wu, International Patent Pub. No. WO/2009/003184, entitled "Digital Microfluidics Based Apparatus for Heat-exchanging Chemical Processes," published on Dec. 31, 2008; Fouillet et al., U.S. Patent Pub. No. 20090192044, entitled "Electrode Addressing Method," published on Jul. 30, 2009; Fouillet et al., U.S. Pat. No. 7,052,244, entitled "Device for Displacement of Small Liquid Volumes Along a Micro-catenary Line by Electrostatic Forces," issued on May 30, 2006; Marchand et al., U.S. Patent Pub. No. 20080124252, entitled "Droplet Microreactor," published on May 29, 2008; Adachi et al., U.S. Patent Pub. No. 20090321262, entitled "Liquid Transfer Device," published on Dec. 31, 2009; Roux et al., U.S. Patent Pub. No. 20050179746, entitled "Device for Controlling the Displacement of a Drop Between two or Several Solid Substrates," published on Aug. 18, 2005; Dhindsa et al., "Virtual Electrowetting Channels: Electronic Liquid Transport with Continuous Channel Functionality," Lab Chip, 10:832-836 (2010); the entire disclosures of which are incorporated herein by reference, along with their priority documents. Certain droplet actuators will include one or more substrates arranged with a droplet operations gap therebetween and electrodes associated with (e.g., layered on, attached to, and/or embedded in) the one or more substrates and arranged to conduct one or more droplet operations. For example, certain droplet actuators will include a base (or bottom) substrate, droplet operations electrodes associated with the substrate, one or more dielectric layers atop the substrate and/or electrodes, and optionally one or more hydrophobic layers atop the substrate, dielectric layers and/or the electrodes forming a droplet operations surface. A top substrate may also be provided, which is separated from the droplet operations surface by a gap, commonly referred to as a droplet operations gap. Various electrode arrangements on the top and/or bottom substrates are discussed in the above-referenced patents and applications and certain novel electrode arrangements are discussed in the description of the invention. During droplet operations it is preferred that droplets remain in continuous contact or frequent contact with a ground or reference electrode. A ground or reference electrode may be associated with the top substrate facing the gap, the bottom substrate facing the gap, in the gap. Where electrodes are provided on both substrates, electrical contacts for coupling the electrodes to a droplet actuator instrument for controlling or monitoring the electrodes may be associated with one or both plates. In some cases, electrodes on one substrate are electrically coupled to the other substrate so that only one substrate is in contact with the droplet actuator. In one embodiment, a conductive material (e.g., an epoxy, such as MASTER BOND™ Polymer System EP79, available from Master Bond, Inc., Hackensack, N.J.) provides the electrical connection between electrodes on one substrate and electrical paths on the other substrates, e.g., a ground electrode on a top substrate may be coupled to an electrical path on a bottom substrate by such a conductive material. Where multiple substrates are used, a spacer may be provided between the substrates to determine the height of the gap therebetween and define dispensing reservoirs. The spacer height may, for example, be from about 5 μm to about 600 μm, or about 100 μm to about 400 μm, or about 200 μm to about 350 μm, or about 250 μm to about 300 μm, or about 275 μm. The spacer may, for example, be formed of a layer of projections form the top or bottom substrates, and/or a material inserted between the top and bottom substrates. One or more openings may be provided in the one or more substrates for forming a fluid path through which liquid may be delivered into the droplet operations gap. The one or more openings may in some cases be aligned for interaction with one or more electrodes, e.g., aligned such that liquid flowed through the opening will come into sufficient proximity with one or more droplet operations electrodes to permit a droplet operation to be effected by the droplet operations electrodes using the liquid. The base (or bottom) and top substrates may in some cases be formed as one integral component. One or more reference electrodes may be provided on the base (or bottom) and/or top substrates and/or in the gap. Examples of reference electrode arrangements are provided in the above referenced patents and patent applications. In various embodiments, the manipulation of droplets by a droplet actuator may be electrode mediated, e.g., electrowetting mediated or dielectrophoresis mediated or Coulombic force mediated. Examples of other techniques for controlling droplet operations that may be used in the droplet actuators of the invention include using devices that induce hydrodynamic fluidic pressure, such as those that operate on the basis of mechanical principles (e.g. external syringe pumps, pneumatic membrane pumps, vibrating membrane pumps, vacuum devices, centrifugal forces, piezoelectric/ultrasonic pumps and acoustic forces); electrical or magnetic principles (e.g. electroosmotic flow, electrokinetic pumps, ferrofluidic plugs, electrohydrodynamic pumps, attraction or repulsion using magnetic forces and magnetohydrodynamic pumps); thermodynamic principles (e.g. gas bubble generation/phase-change-induced volume expansion); other kinds of surface-wetting principles (e.g. electrowetting, and optoelectrowetting, as well as chemically, thermally, structurally and radioactively induced surface-tension gradients); gravity; surface tension (e.g., capillary action); electrostatic forces (e.g., electroosmotic flow); centrifugal flow (substrate disposed on a compact disc and rotated); magnetic forces (e.g., oscillating ions causes flow); magnetohydrodynamic forces; and vacuum or pressure differential. In certain embodiments, combinations of two or more of the foregoing techniques may be employed to conduct a droplet operation in a droplet actuator of the invention. Similarly, one or more of the foregoing may be used to deliver liquid into a droplet operations gap, e.g., from a reservoir in another device or from an external reservoir of the droplet actuator (e.g., a reservoir associated with a droplet actuator substrate and a flow path from the reservoir into the droplet operations gap). Droplet operations surfaces of certain droplet actuators of the invention may be made from hydrophobic materials or may be coated or treated to make them hydrophobic. For example, in some cases some portion or all of the droplet operations surfaces may be derivatized with low surface-energy materials or chemistries, e.g., by deposition or using in situ synthesis using compounds such as poly- or per-fluorinated compounds in solution or polymerizable monomers. Examples include TEFLON® AF (available from DuPont, Wilmington, Del.), members of the cytop family of materials, coatings in the FLUOROPEL® family of hydrophobic and superhydrophobic coatings (available from Cytonix Corporation, Beltsville, Md.), silane coatings, fluorosilane coatings, hydrophobic phosphonate derivatives (e.g., those sold by Aculon, Inc), and NOVEC™ electronic coatings (available from 3M Company, St. Paul, Minn.), and other fluorinated monomers for plasma-enhanced chemical vapor deposition (PECVD). In some cases, the droplet operations surface may include a hydrophobic coating having a thickness ranging from about 10 nm to about 1,000 nm. Moreover, in some embodiments, the top substrate of the droplet actuator includes an electrically conducting organic polymer, which is then coated with a hydrophobic coating or otherwise treated to make the droplet operations surface hydrophobic. For example, the electrically conducting organic polymer that is deposited onto a plastic substrate may be poly(3,4-ethylenedioxythiophene) poly(styrenesulfonate) (PEDOT:PSS). Other examples of electrically conducting organic polymers and alternative conductive layers are described in Pollack et al., International Patent Application No. PCT/US2010/040705, entitled "Droplet Actuator Devices and Methods," the entire disclosure of which is incorporated herein by reference. One or both substrates may be fabricated using a printed circuit board (PCB), glass, indium tin oxide (ITO)-coated glass, and/or semiconductor materials as the substrate. When the substrate is ITO-coated glass, the ITO coating is preferably a thickness in the range of about 20 to about 200 nm, preferably about 50 to about 150 nm, or about 75 to about 125 nm, or about 100 nm. In some cases, the top and/or bottom substrate includes a PCB substrate that is coated with a dielectric, such as a polyimide dielectric, which may in some cases also be coated or otherwise treated to make the droplet operations surface hydrophobic. When the substrate includes a PCB, the following materials are examples of suitable materials: MITSUI™ BN-300 (available from MITSUI Chemicals America, Inc., San Jose Calif.); ARLON™ 11N (available from Arlon, Inc, Santa Ana, Calif.); NELCO® N4000-6 and N5000-30/32 (available from Park Electrochemical Corp., Melville, N.Y.); ISOLA™ FR406 (available from Isola Group, Chandler, Ariz.), especially IS620; fluoropolymer family (suitable for fluorescence detection since it has low background fluorescence); polyimide family; polyester; polyethylene naphthalate; polycarbonate; polyetheretherketone; liquid crystal polymer; cyclo-olefin copolymer (COC); cyclo-olefin polymer (COP); aramid; THERMOUNT® nonwoven aramid reinforcement (available from DuPont, Wilmington, Del.); NOMEX® brand fiber (available from DuPont, Wilmington, Del.); and paper. Various materials are also suitable for use as the dielectric component of the substrate. Examples include: vapor deposited dielectric, such as PARYLENE™ C (especially on glass) and PARYLENE™ N (available from Parylene Coating Services, Inc., Katy, Tex.); TEFLON® AF coatings; cytop; soldermasks, such as liquid photoimageable soldermasks (e.g., on PCB) like TAIYO™ PSR4000 series, TAIYO™ PSR and AUS series (available from Taiyo America, Inc. Carson City, Nev.) (good thermal characteristics for applications involving thermal control), and PROBIMER™ 8165 (good thermal characteristics for applications involving thermal control (available from Huntsman Advanced Materials Americas Inc., Los Angeles, Calif.); dry film soldermask, such as those in the VACREL® dry film soldermask line (available from DuPont, Wilmington, Del.); film dielectrics, such as polyimide film (e.g., KAPTON® polyimide film, available from DuPont, Wilmington, Del.), polyethylene, and fluoropolymers (e.g., FEP), polytetrafluoroethylene; polyester; polyethylene naphthalate; cyclo-olefin copolymer (COC); cyclo-olefin polymer (COP); any other PCB substrate material listed above; black matrix resin; and polypropylene. Droplet transport voltage and frequency may be selected for performance with reagents used in specific assay protocols. Design parameters may be varied, e.g., number and placement of on-actuator reservoirs, number of independent electrode connections, size (volume) of different reservoirs, placement of magnets/bead washing zones, electrode size, inter-electrode pitch, and gap height (between top and bottom substrates) may be varied for use with specific reagents, protocols, droplet volumes, etc. In some cases, a substrate of the invention may derivatized with low surface-energy materials or chemistries, e.g., using deposition or in situ synthesis using poly- or per-fluorinated compounds in solution or polymerizable monomers. Examples include TEFLON® AF coatings and FLUOROPEL® coatings for dip or spray coating, and other fluorinated monomers for plasma-enhanced chemical vapor deposition (PECVD). Additionally, in some cases, some portion or all of the droplet operations surface may be coated with a substance for reducing background noise, such as background fluorescence from a PCB substrate. For example, the noise-reducing coating may include a black matrix resin, such as the black matrix resins available from Toray industries, Inc., Japan. Electrodes of a droplet actuator are typically controlled by a controller or a processor, which is itself provided as part of a system, which may include processing functions as well as data and software storage and input and output capabilities. Reagents may be provided on the droplet actuator in the droplet operations gap or in a reservoir fluidly coupled to the droplet operations gap. The reagents may be in liquid form, e.g., droplets, or they may be provided in a reconstitutable form in the droplet operations gap or in a reservoir fluidly coupled to the droplet operations gap. Reconstitutable reagents may typically be combined with liquids for reconstitution. An example of reconstitutable reagents suitable for use with the invention includes those described in Meathrel, et al., U.S. Pat. No. 7,727,466, entitled "Disintegratable films for diagnostic devices," granted on Jun. 1, 2010.

"Droplet operation" means any manipulation of a droplet on a droplet actuator. A droplet operation may, for example, include: loading a droplet into the droplet actuator; dispensing one or more droplets from a source droplet; splitting, separating or dividing a droplet into two or more droplets; transporting a droplet from one location to another in any direction; merging or combining two or more droplets into a single droplet; diluting a droplet; mixing a droplet; agitating a droplet; deforming a droplet; retaining a droplet in position; incubating a droplet; heating a droplet; vaporizing a droplet; cooling a droplet; disposing of a droplet; transporting a droplet out of a droplet actuator; other droplet operations described herein; and/or any combination of the foregoing. The terms "merge," "merging," "combine," "combining" and the like are used to describe the creation of one droplet from two or more droplets. It should be understood that when such a term is used in reference to two or more droplets, any combination of droplet operations that are sufficient to result in the combination of the two or more droplets into one droplet may be used. For example, "merging droplet A with droplet B," can be achieved by transporting droplet A into contact with a stationary droplet B, transporting droplet B into contact with a stationary droplet A, or transporting droplets A and B into contact with each other. The terms "splitting," "separating" and "dividing" are not intended to imply any particular outcome with respect to volume of the resulting droplets (i.e., the volume of the resulting droplets can be the same or different) or number of resulting droplets (the number of resulting droplets may be 2, 3, 4, 5 or more). The term "mixing" refers to droplet operations which result in more homogenous distribution of one or more components within a droplet. Examples of "loading" droplet operations include microdialysis loading, pressure assisted loading, robotic loading, passive loading, and pipette loading. Droplet operations may be electrode-mediated. In some cases, droplet operations are further facilitated by the use of hydrophilic and/or hydrophobic regions on surfaces and/or by physical obstacles. For examples of droplet operations, see the patents and patent applications cited above under the definition of "droplet actuator." Impedance or capacitance sensing or imaging techniques may sometimes be used to determine or confirm the outcome of a droplet operation. Examples of such techniques are described in Sturmer et al., International Patent Pub. No. WO/2008/101194, entitled "Capacitance Detection in a Droplet Actuator," published on Aug. 21, 2008, the entire disclosure of which is incorporated herein by reference. Generally speaking, the sensing or imaging techniques may be used to confirm the presence or absence of a droplet at a specific electrode. For example, the presence of a dispensed droplet at the destination electrode following a droplet dispensing operation confirms that the droplet dispensing operation was effective. Similarly, the presence of a droplet at a detection spot at an appropriate step in an assay protocol may confirm that a previous set of droplet operations has successfully produced a droplet for detection. Droplet transport time can be quite fast. For example, in various embodiments, transport of a droplet from one electrode to the next may exceed about 1 sec, or about 0.1 sec, or about 0.01 sec, or about 0.001 sec. In one embodiment, the electrode is operated in AC mode but is switched to DC mode for imaging. It is helpful for conducting droplet operations for the footprint area of droplet to be similar to electrowetting area; in other words, 1×-, 2×- 3×-droplets are usefully controlled operated using 1, 2, and 3 electrodes, respectively. If the droplet footprint is greater than the number of electrodes available for conducting a droplet operation at a given time, the difference between the droplet size and the number of electrodes should typically not be greater than 1; in other words, a 2× droplet is usefully controlled using 1 electrode and a 3× droplet is usefully controlled using 2 electrodes. When droplets include beads, it is useful for droplet size to be equal to the number of electrodes controlling the droplet, e.g., transporting the droplet.

"Filler fluid" means a fluid associated with a droplet operations substrate of a droplet actuator, which fluid is sufficiently immiscible with a droplet phase to render the droplet phase subject to electrode-mediated droplet operations. For example, the droplet operations gap of a droplet actuator is typically filled with a filler fluid. The filler fluid may, for example, be a low-viscosity oil, such as silicone oil or hexadecane filler fluid. The filler fluid may fill the entire gap of the droplet actuator or may coat one or more surfaces of the droplet actuator. Filler fluids may be conductive or non-conductive. Filler fluids may, for example, be doped with surfactants or other additives. For example, additives may be selected to improve droplet operations and/or reduce loss of reagent or target substances from droplets, formation of microdroplets, cross contamination between droplets, contamination of droplet actuator surfaces, degradation of droplet actuator materials, etc. Composition of the filler fluid, including surfactant doping, may be selected for performance with reagents used in the specific assay protocols and effective interaction or non-interaction with droplet actuator materials. Examples of filler fluids and filler fluid formulations suitable for use with the invention are provided in Srinivasan et al, International Patent Pub. Nos. WO/2010/027894, entitled "Droplet Actuators, Modified Fluids and Methods," published on Mar. 11, 2010, and WO/2009/021173, entitled "Use of Additives for Enhancing Droplet Operations," published on Feb. 12, 2009; Sista et al., International Patent Pub. No. WO/2008/098236, entitled "Droplet Actuator Devices and Methods Employing Magnetic Beads," published on Aug. 14, 2008; and Monroe et al., U.S. Patent Publication No. 20080283414, entitled "Electrowetting Devices," filed on May 17, 2007; the entire disclosures of which are incorporated herein by reference, as well as the other patents and patent applications cited herein.

"Reservoir" means an enclosure or partial enclosure configured for holding, storing, or supplying liquid. A droplet actuator system of the invention may include on-cartridge reservoirs and/or off-cartridge reservoirs. On-cartridge reservoirs may be (1) on-actuator reservoirs, which are reservoirs in the droplet operations gap or on the droplet operations surface; (2) off-actuator reservoirs, which are reservoirs on the droplet actuator cartridge, but outside the droplet operations gap, and not in contact with the droplet operations surface; or (3) hybrid reservoirs which have on-actuator regions and off-actuator regions. An example of an off-actuator reservoir is a reservoir in the top substrate. An off-actuator reservoir is typically in fluid communication with an opening or flow path arranged for flowing liquid from the off-actuator reservoir into the droplet operations gap, such as into an on-actuator reservoir. An off-cartridge reservoir may be a reservoir that is not part of the droplet actuator cartridge at all, but which flows liquid to some portion of the droplet actuator cartridge. For example, an off-cartridge reservoir may be part of a system or docking station to which the droplet actuator cartridge is coupled during operation. Similarly, an off-cartridge reservoir may be a reagent storage container or syringe which is used to force fluid into an on-cartridge reservoir or into a droplet operations gap. A system using an off-cartridge reservoir will typically include a fluid passage means whereby liquid may be transferred from the off-cartridge reservoir into an on-cartridge reservoir or into a droplet operations gap.

The terms "top," "bottom," "over," "under," and "on" are used throughout the description with reference to the relative positions of components of the droplet actuator, such as relative positions of top and bottom substrates of the droplet actuator. It will be appreciated that the droplet actuator is functional regardless of its orientation in space.

When a droplet is described as being "on" or "loaded on" a droplet actuator, it should be understood that the droplet is arranged on the droplet actuator in a manner which facilitates using the droplet actuator to conduct one or more droplet operations on the droplet, the droplet is arranged on the droplet actuator in a manner which facilitates sensing of a property of or a signal from the droplet, and/or the droplet has been subjected to a droplet operation on the droplet actuator.

6 BRIEF DESCRIPTION OF THE DRAWINGS

7 DETAILED DESCRIPTION OF THE INVENTION

The invention provides layered structures that are useful in a variety of contexts. For example, the layered structures are useful in a variety of microfluidic devices. Examples include microfluidic devices and sensors for microfluidic devices. In one embodiment, the layered structures are employed in microfluidic devices that are configured to employ the layered structures in order to conduct droplet operations. In another embodiment, the layered structures are employed in microfluidic devices that are configured to use the layered structures in order to sense one or more electrical properties of a droplet. In yet another embodiment, the layered structures are employed in microfluidic devices that are configured to use the layered structures to charge or discharge a droplet. Various other uses for the layered structures will be immediately apparent to one of skill in the art.

Figure 1:
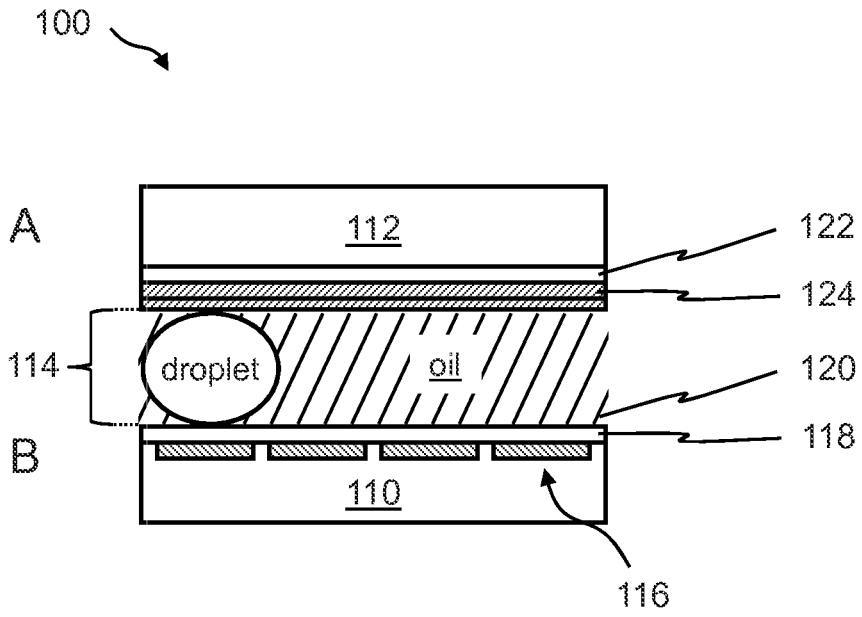
FIG. 1 illustrates a cross-sectional view of an example of a portion of a droplet actuator that uses printed conductive inks to form electrodes and/or ground planes.

FIG. 1 illustrates an example of a microfluidic device employing the layered structures of the invention. The figure illustrates a top layered structure A and a bottom layered structure B. As illustrated, the two layered structures are arranged to form an electrolytic device. However, it will be appreciated that the layered structures may be used separately as components of electro-wetting microfluidic devices or other microfluidic devices. These layered structures are discussed in more detail below.

7.1 Top Substrate

Layered structure A shown in FIG. 1, is also referred to herein as top substrate A. Top substrate A includes a top substrate 112, conductive layer 122, and hydrophobic layer 124.

The top substrate 112 may also include a spacer (not shown) that separates the top substrate 112 from the bottom substrate 110. The spacer sets the gap 114 between a bottom substrate 110 and a top substrate 112 and determines the height of the droplet. Precision in the spacer thickness is required in order to ensure precision in droplet volume, which is necessary for accuracy in an assay. Islands of spacer material are typically required for control of gap height across large cartridges. In one embodiment, the spacer may be integrated within the injection molded polycarbonate material. In another embodiment, the spacer may be formed on the injection molded polycarbonate material by screen printing. Screen printing may be used to form a precision spacer that has small feature sizes and to form isolated spacer islands. A preferred spacer thickness is from about 0.010 inches to about 0.012 inches. In yet another embodiment, the spacer may be screen printed onto a conductive polymer film and laminated onto injection molded polycarbonate material.

Plastics are preferred materials for fabrication of top substrate 112 of a droplet actuator due to their improved manufacturability and potentially lower costs. In one example, top substrate 112 may be formed of injection molded polycarbonate material that has liquid wells (e.g., sample and reagent wells) on one side and is flat on the other side. The top substrate 112 may also include a conductive layer 122. In one embodiment, the conductive layer 122 may be formed by vacuum deposition of a conductive material. In another embodiment, the conductive layer may be formed using conductive polymer films.

The top substrate 112 may also include a spacer (not shown) that separates the top substrate 112 from the bottom substrate 110. The spacer sets the gap between a bottom substrate 110 and a top substrate 112 and determines the height of the droplet. Precision in the spacer thickness is required in order to ensure precision in droplet volume, which is necessary for accuracy in an assay. Islands of spacer material are typically required for control of gap height across large cartridges. In one embodiment, the spacer may be integrated within the injection molded polycarbonate material. In another embodiment, the spacer may be formed on the injection molded polycarbonate material by screen printing. Screen printing may be used to form a precision spacer that has small feature sizes and to form isolated spacer islands. A preferred spacer thickness is from about 0.010 inches to about 0.012 inches. In yet another embodiment, the spacer may be screen printed onto a conductive polymer film and laminated onto injection molded polycarbonate material.

7.2 Bottom Substrate

Layered structure B shown in FIG. 1, is also referred to herein as bottom substrate B. Bottom substrate B includes a bottom substrate 110, conductive elements 116, dielectric layer 118, and hydrophobic layer 124.

Bottom substrate 112 may be formed of any of a wide variety of materials. The materials may be flexible or substantially rigid, rigid, or combinations of the foregoing. Ideally, the material selected for bottom substrate 112 is a dielectric material or a material that is coated with a dielectric material. Examples of suitable materials include printed circuit board (PCB), polymeric materials, plastics, glass, indium tin oxide (ITO)-coated glass, silicon and/or other semiconductor materials. Examples of suitable materials include: MITSUI™ BN-300 (available from MITSUI Chemicals America, Inc., San Jose Calif.); ARLON™ 11N (available from Arlon, Inc, Santa Ana, Calif.); NELCO® N4000-6 and N5000-30/32 (available from Park Electrochemical Corp., Melville, N.Y.); ISOLA™ FR406 (available from Isola Group, Chandler, Ariz.), especially IS620; fluoropolymer family (suitable for fluorescence detection since it has low background fluorescence); polyimide family; polyester; polyethylene naphthalate; polycarbonate; polyetheretherketone; liquid crystal polymer; cyclo-olefin copolymer (COC); cyclo-olefin polymer (COP); aramid; THERMOUNT® nonwoven aramid reinforcement (available from DuPont, Wilmington, Del.); NOMEX® brand fiber (available from DuPont, Wilmington, Del.); and paper.

7.3 Conductive Layer

As explained above, top substrate 112 includes conductive layer 122, and bottom substrate 110 includes conductive elements 116. Conductive layer 122 and/or conductive elements 116 may be formed using a conductive ink material. Conductive inks are sometimes referred to in the art as polymer thick films (PTF). Conductive inks typically include a polymer binder, conductive phase and the solvent phase. When combined, the resultant composition can be printed onto other materials. Thus, according to the invention, conductive layer 122 may be formed using a conductive ink which is printed onto substrate 112. Similarly, conductive element 116 may be formed using a conductive ink which is printed onto bottom substrate 110.

The conductive ink may be a transparent conductive ink. The conductive ink may be a substantially transparent conductive ink. The conductive ink may be selected to transmit electromagnetic radiation (EMR) in a predetermined range of wavelengths. Transmitted EMR may include EMR signal indicative of an assay result. The conductive ink may be selected to filter out EMR in a predetermined range of wavelengths. Filtered EMR may include EMR signal that interferes with measurement of an assay result. The conductive ink may be sufficiently transparent to transmit sufficient EMR to achieve a particular purpose, such as sensing sufficient EMR from an assay to make a quantitative and/or qualitative assessment of the results of the assay within parameters acceptable in the art given the type of assay being performed. Where the layered structure is used as a component of a microfluidic device, and the microfluidic device is used to conduct an assay which produces EMR as a signal indicative of quantity and/or quality of a target substance, the conductive ink may be selected to permit transmission of a sufficient amount of the desired signal in order to achieve the desired purpose of the assay, i.e. a qualitative and/or quantitative measurement through the conductive ink layer of EMR corresponding to target substance in the droplet.

The conductive ink may be sufficiently transparent to permit a sensor to sense from an assay droplet at least 50% of EMR within a target wavelength range which is directed towards the sensor. The conductive ink may be sufficiently transparent to permit a sensor to sense from an assay droplet at least 5% of EMR within a target wavelength range which is directed towards the sensor. The conductive ink may be sufficiently transparent to permit a sensor to sense from an assay droplet at least 90% of EMR within a target wavelength range which is directed towards the sensor. The conductive ink may be sufficiently transparent to permit a sensor to sense from an assay droplet at least 99% of EMR within a target wavelength range which is directed towards the sensor.

A particular microfluidic device may employ multiple conductive inks in different detection regions, such that in one region, one set of one or more signals may be transmitted through the conductive ink and therefore detected, while another set of one or more signals is blocked in that region. Two or more of such regions may be established that block and transmit selected sets of electromagnetic wavelengths. Moreover, where a substrate is used that produces background EMR, conductive inks may be selected on an opposite substrate to block the background energy while permitting transmission of the desired signal from the assay droplet. For example, conductive layer 122 may be selected to block background EMR from bottom substrate 110.

Conductive inks may be employed together with non-conductive inks in order to create a pattern of conductive and non-conductive regions with various optical properties established by the inks. For example, EMR transmitting (e.g., transparent, translucent) conductive inks may be used in a region where detection of EMR through the ink is desired, while EMR blocking (e.g., opaque, ink that filters certain bandwidths) conductive and/or non-conductive inks may be used in a region where detection is not desired in order to control or reduce background EMR. Moreover, conductive inks may be patterned in a manner which permits a droplet to remain in contact with the conductive ink while leaving an opening in the conductive ink for transmission of EMR.

Examples of suitable conductive inks include intrinsically conductive polymers. Examples include CLEVIOS™ PEDOT:PSS (Heraeus Group, Hanau, Germany) and BAYTRON® polymers (Bayer AG, Leverkusen, Germany. Examples of suitable inks in the CLEVIOS™ line include inks formulated for inkjet printing, such as P JET N, P JET HC, P JET N V2, and P JET HC V2. Other conductive inks are available from Orgacon, such as Orgacon PeDot 305+.

The conductive ink may be printed on the surface of top substrate 112 and/or bottom substrate 110. The ink may be patterned to create electrical features, such as electrodes, sensors, grounds, wires, etc. The pattern of the printing may bring the conductive ink into contact with other electrical conductors for controlling the electrical state of the conductive ink electrical elements.

Figure 2:
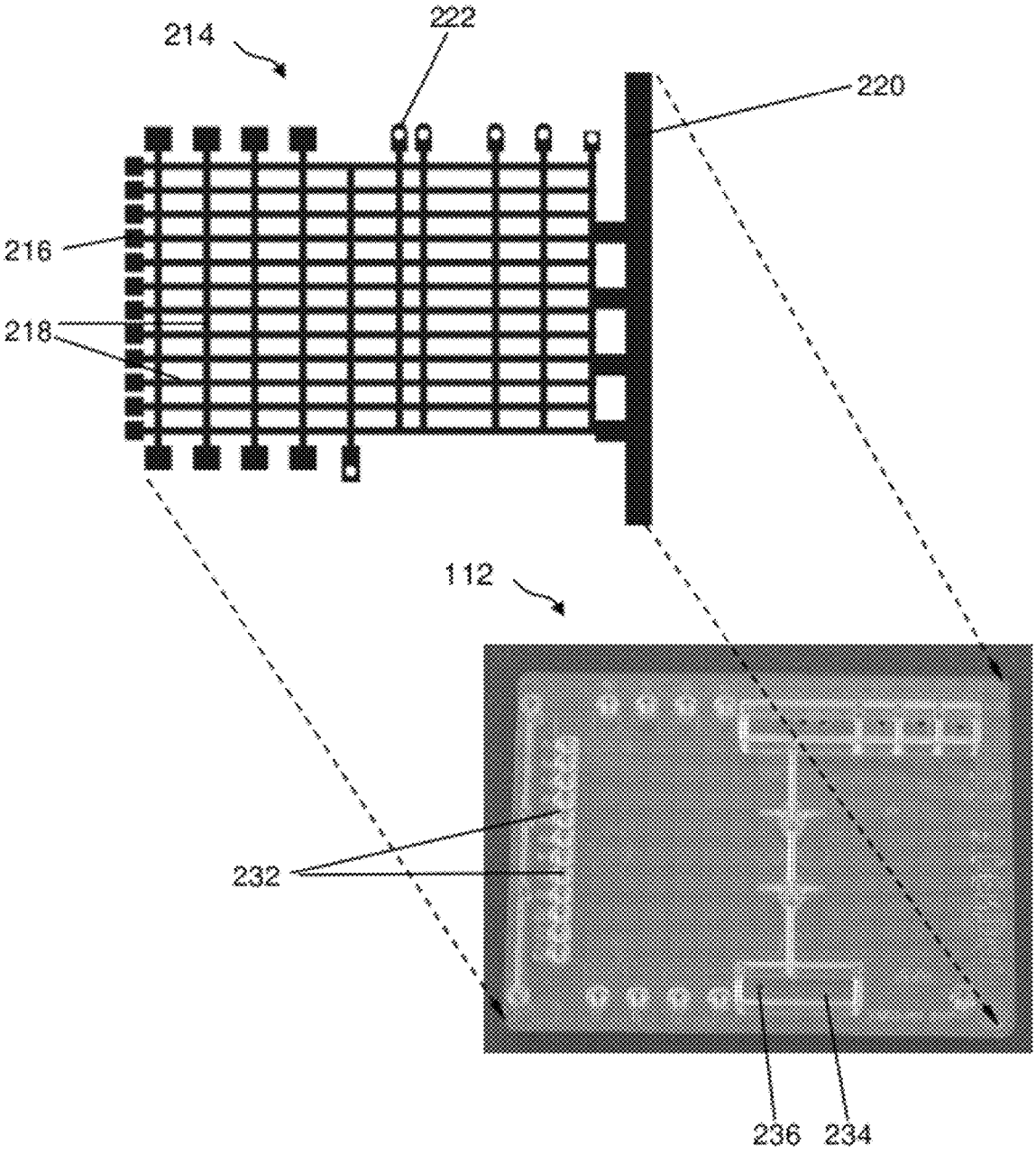
FIG. 2 illustrates a layered substrate having a base layer, an electrically conductive printed ink layer overlying the base layer, and a hydrophobic layer overlying at least a portion of the electrically conductive printed ink layer.

FIG. 2 illustrates top substrate 112. Top substrate 112 includes openings 232 for pipetting liquid through the top substrate 112 into a droplet operations gap. Openings 232 are positioned in proximity to reservoir electrodes situated on a bottom substrate (not shown) and arranged in association with other electrodes for conducting droplet dispensing operations. Top substrate 112 also includes reservoirs 234. Reservoirs 234 are molded into top substrate, and are formed as wells in which liquid can be stored. Reservoirs 234 include openings 236, which provide a fluid passage for flowing liquid from reservoirs 234 through top substrate 212 into a droplet operations gap. Openings 236 are arranged to flow liquid through top substrate 112 and into proximity with one or more droplet dispensing electrodes associated with a bottom substrate (not shown). Top substrate 112 includes a conductive ink reference electrode patterned on a bottom surface of top substrate 112 so that the conductive ink reference electrode faces the droplet operations gap. In this manner, droplets in the droplet operations gap can be exposed to the reference electrode. The reference electrode pattern is designed to align with electrodes and electrode pathways on the bottom substrate. Thus, it can be seen from FIG. 2, that the reference electrode minors the bottom substrate electrodes, including portions 216 and 222 of the reference electrode 214 which correspond to droplet dispensing or reservoir electrodes on the bottom substrate, as well as portions 218 of the reference electrode 214, which correspond to droplet transport pathways established by electrodes on the bottom substrate. Reference electrode 214 also includes a connecting portion 220, which is used to connect reference electrode 214 to a source of reference potential, e.g. a ground electrode.

In one embodiment, the reference electrode pathways 218 overlie and have substantially the same width as electrode pathways on the bottom substrate. This arrangement provides for improved impedance detection of droplets in the droplet operation gap. Impedance across the droplet operations gap from one of more electrodes on the bottom substrate to the reference electrode pathway 218 may be detected in order to determine various factors associated with the gap, such as whether droplet is situated between the bottom electrode and the reference electrode, to what extent the droplet is situated between the bottom electrode and the reference electrode, the contents of a droplet situated between the bottom of electrode and the reference electrode, whether oil has filled the gap between the bottom electrode and the reference electrode, electrical properties of the droplet situated between the bottom electrode and the reference electrode, and electrical properties of the oil situated between the bottom electrode and the reference electrode.

In one embodiment, conductive ink is patterned on substrate 112 and/or substrate 110 to form an arrangement of electrode suitable for conducting one or more droplet operations. In one embodiment, the droplet operations are electrowetting-mediated droplet operations. In another embodiment, the droplet operations are dielectrophoresis-mediated droplet operations.

In one embodiment, the substrate is subject to a corona treatment prior to application of the conductive ink. For example, the corona treatment may be conducted using a high-frequency spot generator, such as the SpotTec™ spot generator (Tantec A/S, Lunderskov, Denmark). In another embodiment, the substrate is subject to plasma treatment prior to application of the conductive ink.

7.4 Dielectric Layer

In some embodiments, the layered structure will also include a dielectric layer. A dielectric layer is useful, for example, when the conductive ink is patterned to form electrodes for conducting droplet operations. For example, the droplet operations may be electrowetting-mediated droplet operations or dielectrophoresis-mediated droplet operations. FIG. 1, bottom substrate B includes dielectric layer 118 layered atop a patterned conductive layer 116, which may be a conductive ink layer. Various materials are suitable for use as the dielectric layer. Examples include: vapor deposited dielectric, such as PARYLENE™ C (especially on glass) and PARYLENE™ N (available from Parylene Coating Services, Inc., Katy, Tex.); TEFLON® AF coatings; cytop; soldermasks, such as liquid photoimageable soldermasks (e.g., on PCB) like TAIYO™ PSR4000 series, TAIYO™ PSR and AUS series (available from Taiyo America, Inc. Carson City, Nev.) (good thermal characteristics for applications involving thermal control), and PROBIMER™ 8165 (good thermal characteristics for applications involving thermal control (available from Huntsman Advanced Materials Americas Inc., Los Angeles, Calif.); dry film soldermask, such as those in the VACREL® dry film soldermask line (available from DuPont, Wilmington, Del.); film dielectrics, such as polyimide film (e.g., KAPTON® polyimide film, available from DuPont, Wilmington, Del.), polyethylene, and fluoropolymers (e.g., FEP), polytetrafluoroethylene; polyester; polyethylene naphthalate; cyclo-olefin copolymer (COC); cyclo-olefin polymer (COP); any other PCB substrate material listed above; black matrix resin; and polypropylene. Thus, in one embodiment, the invention includes a base layer, a conductive ink layer on the base layer, and a dielectric layer overlying the conductive ink layer and any exposed portions of the base layer. The base layer may be a substrate, such as described above with respect to FIG. 1 substrate 112 and substrate 110.

7.5 Hydrophobic Layer

As illustrated in FIG. 1, with respect to substrate A hydrophobic layer 124 may be deposited on conductive layer 122. Similarly, with respect to substrate B, hydrophobic layer 120 may be deposited atop dielectric layer 118. It will be appreciated that where the conductive ink layer and/or the dielectric layer is patterned, the hydrophobic layer may cover the conductive ink layer in some regions while covering the dielectric layer or even the base layer and other regions of the substrate. Focusing here on the conductive ink layer, the conductive ink layer may be derivatized with low surface-energy materials or chemistries, e.g., by deposition or using in situ synthesis using compounds such as poly- or per-fluorinated compounds in solution or polymerizable monomers. Examples include TEFLON® AF (available from DuPont, Wilmington, Del.), members of the CYTOP family of materials, coatings in the FLUOROPEL® family of hydrophobic and superhydrophobic coatings (available from Cytonix Corporation, Beltsville, Md.), silane coatings, fluorosilane coatings, hydrophobic phosphonate derivatives (e.g., those sold by Aculon, Inc), and NOVEC™ electronic coatings (available from 3M Company, St. Paul, Minn.), and other fluorinated monomers for plasma-enhanced chemical vapor deposition (PECVD). In some cases, the hydrophobic coating may have a thickness ranging from about 10 nm to about 1,000 nm.

7.6 Systems

Figure 3:
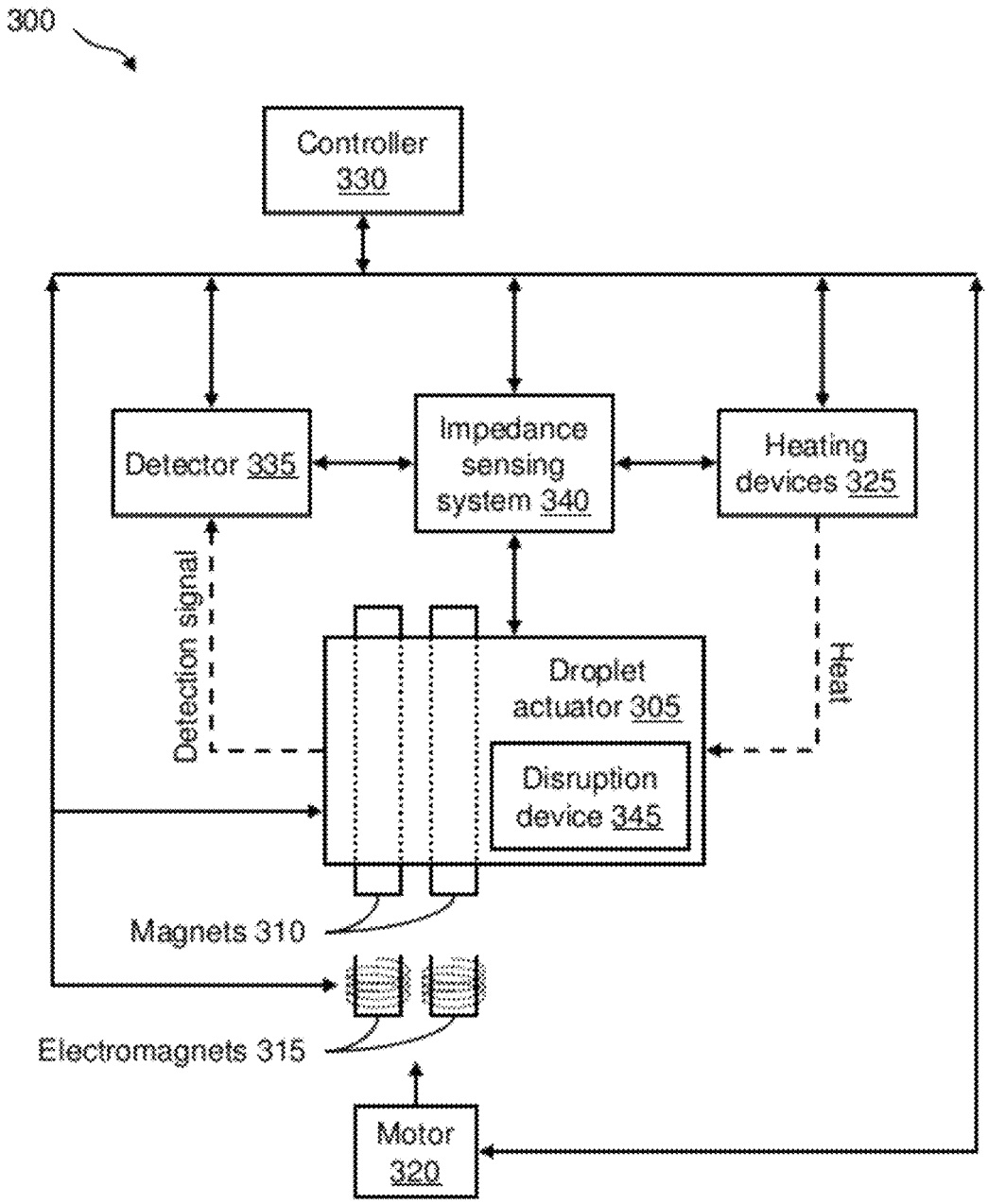
FIG. 3 illustrates a functional block diagram of an example of a microfluidics system that includes a droplet actuator of the present invention.

FIG. 3 illustrates a functional block diagram of an example of a microfluidics system 300 that includes a droplet actuator 305. Digital microfluidic technology conducts droplet operations on discrete droplets in a droplet actuator, such as droplet actuator 305, by electrical control of their surface tension (electrowetting). The droplets may be sandwiched between two substrates of droplet actuator 305, a bottom substrate and a top substrate separated by a droplet operations gap. The bottom substrate may include an arrangement of electrically addressable electrodes. The top substrate may include a reference electrode plane made, for example, from conductive ink or indium tin oxide (ITO). The bottom substrate and the top substrate may be coated with a hydrophobic material. The space around the droplets (i.e., the droplet operations gap between bottom and top substrates) may be filled with an immiscible inert fluid, such as silicone oil, to prevent evaporation of the droplets and to facilitate their transport within the device. Other droplet operations may be effected by varying the patterns of voltage activation; examples include merging, splitting, mixing, and dispensing of droplets.

Droplet actuator 305 may be designed to fit onto an instrument deck (not shown) of microfluidics system 300. The instrument deck may hold droplet actuator 305 and house other droplet actuator features, such as, but not limited to, one or more magnets and one or more heating devices. For example, the instrument deck may house one or more magnets 310, which may be permanent magnets. Optionally, the instrument deck may house one or more electromagnets 315. Magnets 310 and/or electromagnets 315 are positioned in relation to droplet actuator 305 for immobilization of magnetically responsive beads. Optionally, the positions of magnets 310 and/or electromagnets 315 may be controlled by a motor 320. Additionally, the instrument deck may house one or more heating devices 325 for controlling the temperature within, for example, certain reaction and/or washing zones of droplet actuator 305. In one example, heating devices 325 may be heater bars that are positioned in relation to droplet actuator 305 for providing thermal control thereof.

A controller 330 of microfluidics system 300 is electrically coupled to various hardware components of the invention, such as droplet actuator 305, electromagnets 315, motor 320, and heating devices 325, as well as to a detector 335, an impedance sensing system 340, and any other input and/or output devices (not shown). Controller 330 controls the overall operation of microfluidics system 300. Controller 330 may, for example, be a general purpose computer, special purpose computer, personal computer, or other programmable data processing apparatus. Controller 330 serves to provide processing capabilities, such as storing, interpreting, and/or executing software instructions, as well as controlling the overall operation of the system. Controller 330 may be configured and programmed to control data and/or power aspects of these devices. For example, in one aspect, with respect to droplet actuator 305, controller 330 controls droplet manipulation by activating/deactivating electrodes.

In one example, detector 335 may be an imaging system that is positioned in relation to droplet actuator 305. In one example, the imaging system may include one or more light-emitting diodes (LEDs) (i.e., an illumination source) and a digital image capture device, such as a charge-coupled device (CCD) camera.

Impedance sensing system 340 may be any circuitry for detecting impedance at a specific electrode of droplet actuator 305. In one example, impedance sensing system 340 may be an impedance spectrometer. Impedance sensing system 340 may be used to monitor the capacitive loading of any electrode, such as any droplet operations electrode, with or without a droplet thereon. For examples of suitable capacitance detection techniques, see Sturmer et al., International Patent Publication No. WO/2008/101194, entitled "Capacitance Detection in a Droplet Actuator," published on Aug. 21, 2008; and Kale et al., International Patent Publication No. WO/2002/080822, entitled "System and Method for Dispensing Liquids," published on Oct. 17, 2002; the entire disclosures of which are incorporated herein by reference.

Droplet actuator 305 may include disruption device 345. Disruption device 345 may include any device that promotes disruption (lysis) of materials, such as tissues, cells and spores in a droplet actuator. Disruption device 345 may, for example, be a sonication mechanism, a heating mechanism, a mechanical shearing mechanism, a bead beating mechanism, physical features incorporated into the droplet actuator 3105, an electric field generating mechanism, a thermal cycling mechanism, and any combinations thereof. Disruption device 345 may be controlled by controller 330.

It will be appreciated that various aspects of the invention may be embodied as a method, system, computer readable medium, and/or computer program product. Aspects of the invention may take the form of hardware embodiments, software embodiments (including firmware, resident software, micro-code, etc.), or embodiments combining software and hardware aspects that may all generally be referred to herein as a "circuit," "module" or "system." Furthermore, the methods of the invention may take the form of a computer program product on a computer-usable storage medium having computer-usable program code embodied in the medium.

Any suitable computer useable medium may be utilized for software aspects of the invention. The computer-usable or computer-readable medium may be, for example but not limited to, an electronic, magnetic, optical, electromagnetic, infrared, or semiconductor system, apparatus, device, or propagation medium. The computer readable medium may include transitory and/or non-transitory embodiments. More specific examples (a non-exhaustive list) of the computer-readable medium would include some or all of the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission medium such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device.

Program code for carrying out operations of the invention may be written in an object oriented programming language such as Java, Smalltalk, C++ or the like. However, the program code for carrying out operations of the invention may also be written in conventional procedural programming languages, such as the "C" programming language or similar programming languages. The program code may be executed by a processor, application specific integrated circuit (ASIC), or other component that executes the program code. The program code may be simply referred to as a software application that is stored in memory (such as the computer readable medium discussed above). The program code may cause the processor (or any processor-controlled device) to produce a graphical user interface ("GUI"). The graphical user interface may be visually produced on a display device, yet the graphical user interface may also have audible features. The program code, however, may operate in any processor-controlled device, such as a computer, server, personal digital assistant, phone, television, or any processor-controlled device utilizing the processor and/or a digital signal processor.

The program code may locally and/or remotely execute. The program code, for example, may be entirely or partially stored in local memory of the processor-controlled device. The program code, however, may also be at least partially remotely stored, accessed, and downloaded to the processor-controlled device. A user's computer, for example, may entirely execute the program code or only partly execute the program code. The program code may be a stand-alone software package that is at least partly on the user's computer and/or partly executed on a remote computer or entirely on a remote computer or server. In the latter scenario, the remote computer may be connected to the user's computer through a communications network.

The invention may be applied regardless of networking environment. The communications network may be a cable network operating in the radio-frequency domain and/or the Internet Protocol (IP) domain. The communications network, however, may also include a distributed computing network, such as the Internet (sometimes alternatively known as the "World Wide Web"), an intranet, a local-area network (LAN), and/or a wide-area network (WAN). The communications network may include coaxial cables, copper wires, fiber optic lines, and/or hybrid-coaxial lines. The communications network may even include wireless portions utilizing any portion of the electromagnetic spectrum and any signaling standard (such as the IEEE 802 family of standards, GSM/CDMA/TDMA or any cellular standard, and/or the ISM band). The communications network may even include powerline portions, in which signals are communicated via electrical wiring. The invention may be applied to any wireless/wireline communications network, regardless of physical componentry, physical configuration, or communications standard(s).

Certain aspects of invention are described with reference to various methods and method steps. It will be understood that each method step can be implemented by the program code and/or by machine instructions. The program code and/or the machine instructions may create means for implementing the functions/acts specified in the methods.

The program code may also be stored in a computer-readable memory that can direct the processor, computer, or other programmable data processing apparatus to function in a particular manner, such that the program code stored in the computer-readable memory produce or transform an article of manufacture including instruction means which implement various aspects of the method steps.

The program code may also be loaded onto a computer or other programmable data processing apparatus to cause a series of operational steps to be performed to produce a processor/computer implemented process such that the program code provides steps for implementing various functions/acts specified in the methods of the invention.

8 CONCLUDING REMARKS

The foregoing detailed description of embodiments refers to the accompanying drawings, which illustrate specific embodiments of the invention. Other embodiments having different structures and operations do not depart from the scope of the present invention. The term "the invention" or the like is used with reference to specific examples of the many alternative aspects or embodiments of the applicants' invention set forth in this specification, and neither its use nor its absence is intended to limit the scope of the applicants' invention or the scope of the claims. This specification is divided into sections for the convenience of the reader only. Headings should not be construed as limiting of the scope of the invention. The definitions are intended as a part of the description of the invention. It will be understood that various details of the present invention may be changed without departing from the scope of the present invention. Furthermore, the foregoing description is for the purpose of illustration only, and not for the purpose of limitation.

I claim:

1. A microfluidic device comprising: a layered substrate comprising:

(a) a base substrate;

(b) an electrically conductive element comprising a conductive ink layer on the base substrate; and (c) a hydrophobic layer overlying at least a portion of the conductive ink layer in the base substrate; and further comprising a second substrate separated from the layered substrate to provide a gap between the layered substrate and the second substrate.

2. The layered substrate of claim 1 wherein the conductive ink comprises a PEDOT ink.

3. The layered substrate of claim 1 wherein the conductive ink comprises a PEDOT:PSS ink.

4. The layered substrate of claim 1 wherein the conductive ink comprises a PEDOT ink and the hydrophobic layer comprises a CYTOP coating.

5. The layered substrate of claim 1 wherein the conductive ink comprises a PEDOT:PSS ink and the hydrophobic layer comprises a CYTOP coating.

6. The layered substrate of claim 1 wherein the conductive ink comprises a PEDOT ink and the hydrophobic layer comprises a fluoropolymer coating.

7. The layered substrate of claim 1 wherein the conductive ink comprises a PEDOT:PSS ink and the hydrophobic layer comprises a fluoropolymer coating.

8. The layered substrate of claim 1 wherein the conductive ink comprises a PEDOT ink and the hydrophobic layer comprises an amorphous fluoropolymer coating.

9. The layered substrate of claim 1 wherein the conductive ink comprises a PEDOT:PSS ink and the hydrophobic layer comprises an amorphous fluoropolymer coating.

10. The microfluidic device of claim 1 wherein the second substrate comprises: (a) an electrically conductive element comprising a conductive ink layer on the second substrate facing the gap; and (b) a hydrophobic layer overlying at least a portion of the conductive ink layer on the second substrate.

11. The microfluidic device of claim 1 further comprising a droplet in the gap.

12. The microfluidic device of claim 1 further comprising an oil filler fluid in the gap.

13. The layered substrate of claim 1 wherein the base substrate is made from a material selected from the group consisting of silicon-based materials, glass, plastic and PCB.

14. The layered substrate of claim 1 wherein the base substrate is made from a material selected from the group consisting of glass, polycarbonate, COC, COP, PMMA, polystyrene and plastic.

15. The layered substrate of claim 1 wherein the hydrophobic layer material comprises a fluoropolymer.

16. The layered substrate of claim 1 wherein the hydrophobic layer material comprises an amorphous fluoropolymer.

17. The layered substrate of claim 1 wherein the hydrophobic layer material comprises a polytetrafluoroethylene polymer.

18. The layered substrate of claim 1 wherein the conductive ink layer comprises a poly(3,4-ethylenedioxythiophene)-poly(styrenesulfonate) material.

19. The layered substrate of claim 1 wherein the conductive ink layer comprises at least one of CLEVOS P Jet N, CLEVOS P Jet HC, CLEVOS P Jet N V2 and CLEVOS P Jet HC V2.

20. A layered substrate comprising:

(a) a base substrate;

(b) an electrically conductive element comprising the conductive ink layer on the base substrate; and (c) a hydrophobic layer overlying at least a portion of the conductive ink layer in the base substrate; and wherein the electrically conductive element comprising a conductive ink layer on the base substrate comprises an electrode in an array of electrodes.

21. The layered substrate of claim 20 further comprising a droplet on the hydrophobic layer.

22. The layered substrate of claim 20 further comprising an oil filler fluid on the hydrophobic layer.

23. A layered substrate comprising:

(a) a base substrate;

(b) an electrically conductive element comprising the conductive ink layer on the base substrate; and (c) a hydrophobic layer overlying at least a portion of the conductive ink layer in the base substrate; and wherein the electrically conductive element comprising a conductive ink layer on the base substrate comprises electrowetting electrodes.

24. A layered substrate comprising:

(a) a base substrate;

(b) an electrically conductive element comprising the conductive ink layer on the base substrate; and (c) a hydrophobic layer overlying at least a portion of the conductive ink layer on the base substrate; and further comprising a dielectric layer disposed between the an electrically conductive element comprising a conductive ink layer on the base substrate and the hydrophobic layer overlying at least a portion of the conductive ink layer on the base substrate.

25. A layered substrate comprising:

(a) a base substrate;

(b) an electrically conductive element comprising a conductive ink layer on the base substrate; and (c) a hydrophobic layer overlying at least a portion of the conductive ink layer on the base substrate;

wherein the base substrate is subject to a corona treatment prior to applying the conductive ink.

26. A layered substrate comprising:

(a) a base substrate (b) an electrically conductive element comprising a conductive ink layer on the base substrate; and (c) a hydrophobic layer overlying at least a portion of the conductive ink layer on the base substrate;

wherein the conductive ink comprises a CYTOP and the CYTOP is applied as a formulation in which the CYTOP is dissolved in a fluorinert solvent.

* * * * *